US005907819A

United States Patent [19]

Johnson

[11] Patent Number: 5,907,819

[45] **Date of Patent: *May 25, 1999**

[54] GOLF SWING ANALYSIS SYSTEM

[76] Inventor: Lee Edward Johnson, 3800 North Lake Shore Dr. Apt. 11E, Chicago, Ill. 60613

[ * ] Notice: This patent is subject to a terminal disclaimer.

[21] Appl. No.: 08/871,438

[22] Filed: Jun. 9, 1997

Related U.S. Application Data

[63] Continuation of application No. 08/349,442, Dec. 5, 1994, Pat. No. 5,638,300.

[51] Int. Cl.[6] ..... G01B 17/00

[52] U.S. Cl. ..... 702/152; 702/153; 473/223

[58] Field of Search ..... 364/550, 557.01, 364/559–561, 565, 566, 410; 434/252; 73/379.07; 340/829.72; 473/198–224; 702/127, 142, 149–153

[56] References Cited

U.S. PATENT DOCUMENTS

| | | | |
|---|---|---|---|
| 3,820,130 | 6/1974 | Cornelison, Jr. . | |
| 4,163,941 | 8/1979 | Linn, Jr. . | |
| 4,251,077 | 2/1981 | Pelz et al. . | |
| 4,304,406 | 12/1981 | Cromarty . | |
| 4,451,043 | 5/1984 | Ogawa et al. . | |
| 4,524,348 | 6/1985 | Lefkowitz | 340/365 R |
| 4,631,676 | 12/1986 | Pugh . | |
| 4,688,037 | 8/1987 | Krieg | 340/825.72 |
| 4,713,686 | 12/1987 | Ozaki et al. . | |
| 4,839,838 | 6/1989 | LaBiche et al. | 364/707.11 |
| 4,849,692 | 7/1989 | Blood . | |
| 4,869,509 | 9/1989 | Lee . | |
| 4,891,748 | 1/1990 | Mann . | |
| 4,896,283 | 1/1990 | Hunt et al. . | |
| 4,911,441 | 3/1990 | Brunner . | |
| 4,939,838 | 6/1989 | LaBiche et al. | 364/709.11 |
| 4,951,079 | 8/1990 | Hoshino et al. . | |
| 4,979,745 | 12/1990 | Kobayashi . | |
| 4,991,850 | 2/1991 | Wilhlem . | |
| 5,034,811 | 7/1991 | Palm . | |

(List continued on next page.)

FOREIGN PATENT DOCUMENTS

| | | |
|---|---|---|
| 0 278 150 | 8/1988 | European Pat. Off. . |
| WO 91/06348 | 5/1991 | WIPO . |

OTHER PUBLICATIONS

"The Influence of Dynamic Factors on Triaxial Net Muscular Moments at the L5/S1 Joint During Asymmetrical Lifting and Lowering," by Denis Gagnon, Biomechanics, vol. 25, No. 4, 1992, pp. 891–901.

"WAVI®" advertisement. Published by Sports Technology, Inc. Essex, Connecticut. While the date of the advertisement is unknown, it is believed that the advertisement was available to the public prior to the filing of the above–identified application, No date.

"SPORTECH®" advertisement. Published by Sports Technology, Inc. Essex, Connecticut While the date of the advertisement is unknown, it is believed that the advertisement was available to the public prior to the filing of the above–identified application, No date.

"Golftek®" advertisement. Published by Golftek, Lewiston, Idaho. Published 1992.

(List continued on next page.)

*Primary Examiner*—James P. Trammell

*Attorney, Agent, or Firm*—Brinks Hofer Gilson & Lione

[57] ABSTRACT

The present invention concerns a motion analysis system for analyzing the motion of an individual. The system has a control surface having one or more control areas, each control area corresponding to a predetermined instruction. An object is then held by an individual for use with the control surface. The system has a sensor for detecting the position of the object and producing a signal representative of the position. An analyzer then receives the signal from the sensor, wherein when the object is positioned at one of the control areas on the control surface the analyzer performs the predetermined instruction corresponding to the control area that the object is positioned.

29 Claims, 15 Drawing Sheets

U.S. PATENT DOCUMENTS

| | | | |
|---|---|---|---|
| 5,067,717 | 11/1991 | Harlan et al. . | |
| 5,087,047 | 2/1992 | McConnell | 273/183 B |
| 5,111,410 | 5/1992 | Nakayama et al. . | |
| 5,154,427 | 10/1992 | Harlan et al. . | |
| 5,233,544 | 8/1993 | Kobayashi . | |
| 5,246,232 | 9/1993 | Eccher et al. . | |
| 5,297,061 | 3/1994 | Demonthon et al. | 364/559 |
| 5,406,307 | 4/1995 | Hirayama et al. | 345/120 |
| 5,511,789 | 4/1996 | Nakamura | 473/202 |
| 5,638,300 | 6/1997 | Johnson | 364/51.01 |

OTHER PUBLICATIONS

"BIOVISION" advertisement, Published by the Optimum Human Performance Center, Menlo Park, California. While the date of the advertisement is unknown, it is believed that the advertisement was available to the public prior to the filing of the above–identified application, No Date.

"Introducing the Swing Motion Trainer," by SportSense, Inc. Published by SportSense, Inc., Mountain View, California. While the date of the article is unknown, it is believed that the article was available to the public prior to the filing of the above–identified application, No Date.

"SportSense" advertisement. Published by SportSense, Inc., Mountain View, California. While the date of the advertisement is unknown, it is believed that the advertisement was available to the public prior to the filing of the above–identified application, no date.

"Mythbuster—Breakthrough Technology Refutes Things about the Swing the Golf World has Long Accepted as Fact," by Jonathan Abrahams. Golf Magazine, Nov. 1992, pp. 88–89.

"Widen the Gap," by Jim McLean, Golf Magazine, Dec. 1992, pp. 49–51.

"X Factor 2 Closing the Gap," by Jim McLean, Golf Magazine, Aug. 1993, pp. 29–31.

"The Flock of Birds® Position and Orientation Measurement System Installation and Operation Guide." Published in 1994 by Ascension Technology Corporation, Burlington, Vermont. While the exact date of the guide is unknown, it is believed that the guide was available to the public prior to the filing of the above–identified application.

News release entitled "Ascension's Long Range Flock Chosen for State–of–the–Art Performance Animation System Developed by Pacific Data Image (PDI), " released by Ascension Technology Corporation, Inc., Burlington, Vermont. While the date of the news release is unknown, it is believed that the news release was available to the public prior to the filing of the above–identified application, No Date. 6/1997Johnson364/551.01

PROCESS FLOW

CALIBRATE VIRTUAL PAD

USER SIGN-ON

REQUEST CLUB

REQUEST CLUB CONT.'

REQUEST NEW BALL

REQUEST NEW BALL CONT'

REQUEST RESULTS

REQUEST PLAYBACK

COMPUTE VIEWING ANGLES

REQUEST COMPARE SWINGS

PERFORM ANALSIS

REQUEST SAVE SWING

REQUEST FOR TRAINING

REQUEST FOR TRAINING CONT.'

GOLF SWING ANALYSIS SYSTEM

This application is a continuation of application Ser. No. 08/349,442 filed Dec. 5, 1994 U.S. Pat. No. 5,638,300.

BACKGROUND OF THE INVENTION

1. Field of the Invention

The present invention relates to a system for analyzing the movement of an individual while participating in a sport or activity that involves the movement of a handled object, tool or instrument. In particular, the present invention relates to a golf swing analysis system that measures the movement of a golfer's swing from address to impact of the golf ball to the follow through and reconstructs and displays various points of view of the swing from the measured movement.

2. Discussion of Related Art

Golf is one of the fastest growing sports in the world. Unfortunately, for both beginners and veterans of the game, it is one of the most difficult games to master. The difficulty of the game is not caused by a need for any particular physical attribute, such as height in basketball, for example. Indeed, many of the top golfers in the world are average in height and weight. The key to the success of top golfers is that they have tremendous hand-to-eye coordination and the innate ability to swing a golf club in a way to maximize the ability to hit the golf ball with both power and accuracy.

Since most golfers are not born with such a talent, the only way to improve their swing is to practice individually or with professional help. The majority of players learn the game from a friend and develop their swing by trial and error on the golf course and at the driving range. However, learning the game in this manner can inhibit how good the player's swing can become. The player needs a way to analyze his or her swing after the swing has been made.

Players who obtain the assistance of a teaching professional often experience disappointment with their failure to improve. Sometimes the student is unable to relate the instructor's comments to the look and "feel" of the actual swing. At other times, the student reverts to their old habits immediately after the lesson as they have not retrained their muscles and have no objective feedback as to when the swing pattern is proper. In this situation, both the student and professional need a system to illustrate and reinforce the concepts being taught.

Some systems have been developed to respond to the needs of both the self-taught player and the professionally taught player. Examples of such systems are: (1) the Sportech Golf Swing Analyzer and WAVI™ system both manufactured by Sports Technology, Inc. of Essex, Conn.; (2) BioVision™ manufactured by Optimum Human Performance Centers, Inc. of Menlo Park, Calif.; (3) the Pro Grafix System manufactured by GolfTek of Lewiston, Id.; (4) the Swing Motion Trainer manufactured by Sport Sense of Mountain View, Calif.; and (5) U.S. Pat. No. 5,111,410 to Nakayama et al.

In Nakayama et al., a golfer wears a number of reflective tapes at various places on his or her body. While the player swings the club, a TV camera captures the motion of the golfer through the motion of the reflective tape. The image of the motion is digitized and the two-dimensional coordinates of the reflective tapes are calculated. The calculated coordinates are then manipulated in various ways to analyze the golfer's swing. For example, the coordinates can be used to construct a moving stick figure representing the golfer's swing.

Nakayama et al.'s system has several disadvantages. For example, Nakayama et al. is limited by the information it can convey to the user, since only a single view of the swing is generated for viewing.

SUMMARY OF THE INVENTION

The present invention concerns a motion analysis system for analyzing the motion of an individual. The system has a control surface having one or more control areas, each control area corresponding to a predetermined instruction. An object is then held by an individual for use with the control surface. The system has a sensor for detecting the position of the object and producing a signal representative of the position. An analyzer then receives the signal from the sensor, wherein when the object is positioned at one of the control areas on the control surface the analyzer performs the predetermined instruction corresponding to the control area that the object is positioned.

The present invention provides improved operability for an individual to run a motion analysis system by allowing the individual to run the system by moving an object to various positions.

The present invention also provides the advantage of allowing the individual to view his or her motion on a display from a wide variety of viewing angles.

The foregoing features and advantages of the present invention will be further understood upon consideration of the following detailed description of the invention taken in conjunction with the accompanying drawings, in which:

DESCRIPTION OF THE PREFERRED EMBODIMENT

The motion analysis system of the present invention is best understood by a review of FIGS. 1–19. The description to follow will concern a golf swing analysis system. However, it is understood that the present invention can be used to analyze the motion of other objects held and moved by an individual. In particular, the object can be a piece of sports equipment, such as a baseball bat, a tennis racket or a hockey stick.

Figure 2:
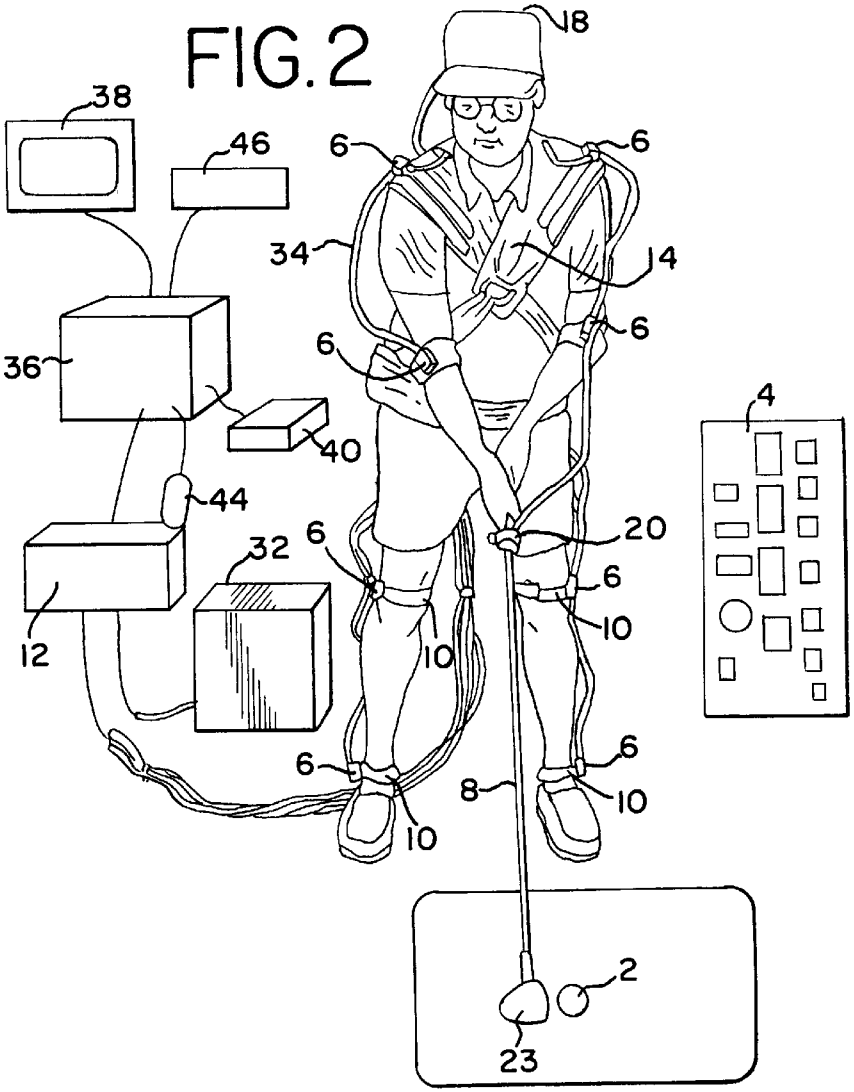
FIG. 2 shows a front view of a golfer using the golf swing analysis system of FIG. 1.
Figure 1:
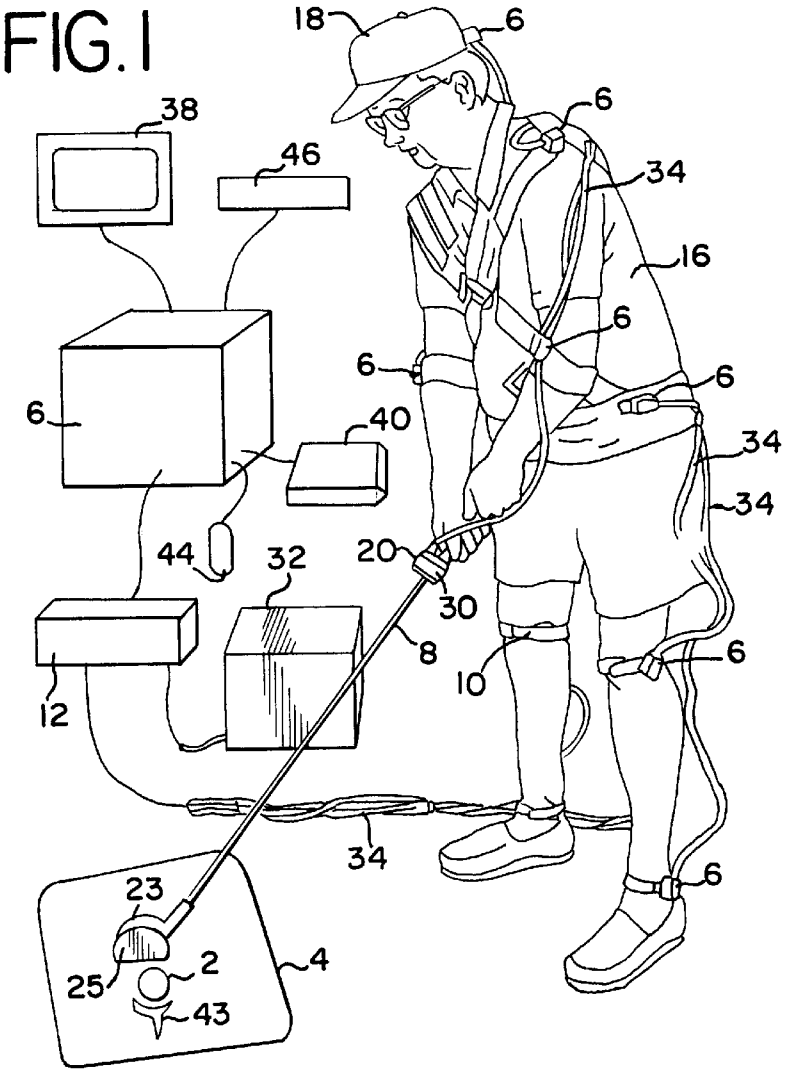
FIG. 1 shows a side view of a golfer using the golf swing analysis system according to the present invention.

In FIGS. 1 and 2, a golfer is shown in the address position holding a golf club ready to start his swing to hit a golf ball 2 positioned separately from a control surface, such as control pad 4, as seen in FIG. 2. It is understood that, without departing from the spirit of the invention, the golf ball 2 may be positioned on the control pad 2 as well as seen in FIG. 1.

A plurality of sensors 6 are positioned at several critical areas on the golfer's body in order to thoroughly measure and analyze the golfer's swing. Since a golf swing involves a complicated physical movement, sensors are preferably placed at key joints of the golfer. As seen in FIGS. 1 and 2, the sensors 6 preferably are placed at both of the ankles, knees, hips, elbows and shoulders of the golfer. It is understood that other sensors may be worn as well, such as on the wrists. A single sensor 6 for the golfer's head and the club 8 are used as well. The sensors 6 for the ankles, knees and elbows preferably are attached to straps 10 wrapped around the joint. The sensors 6 are attached to straps 10 by an adhesive or via a hook and loop attachment system, such as the system known by the name of VELCRO™. The sensors 6 for the hips and the shoulders are also attached by strips sewn onto the vest, where the strips are made of a hook and loop attachment system, such as the system known by the name VELCRO™. As seen in FIGS. 1 and 2, vest 14 is wrapped around the body of the golfer leaving the sides 16 of the golfer free for movement during the swing. Regarding the other sensors, sensor 6 for the head is attached to the back of a hat 18 by a hook and loop attachment system, such as the system known by VELCRO™. Since hat 18 when worn moves with the head of the golfer, the sensor 6 attached thereto accurately detects head movement of the golfer.

Figure 5A:
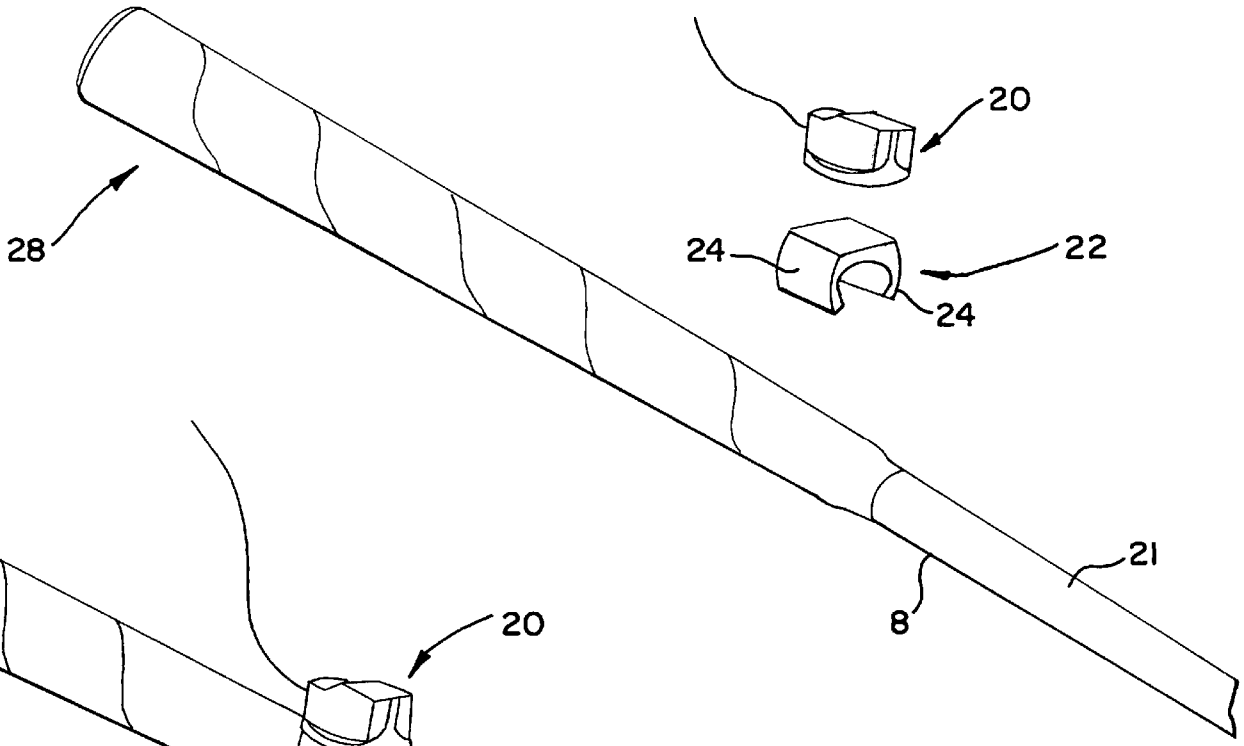
FIG. 5A shows an exploded view of a golf club sensor to be used with the golf swing analysis system of FIG. 1.
Figure 5B:
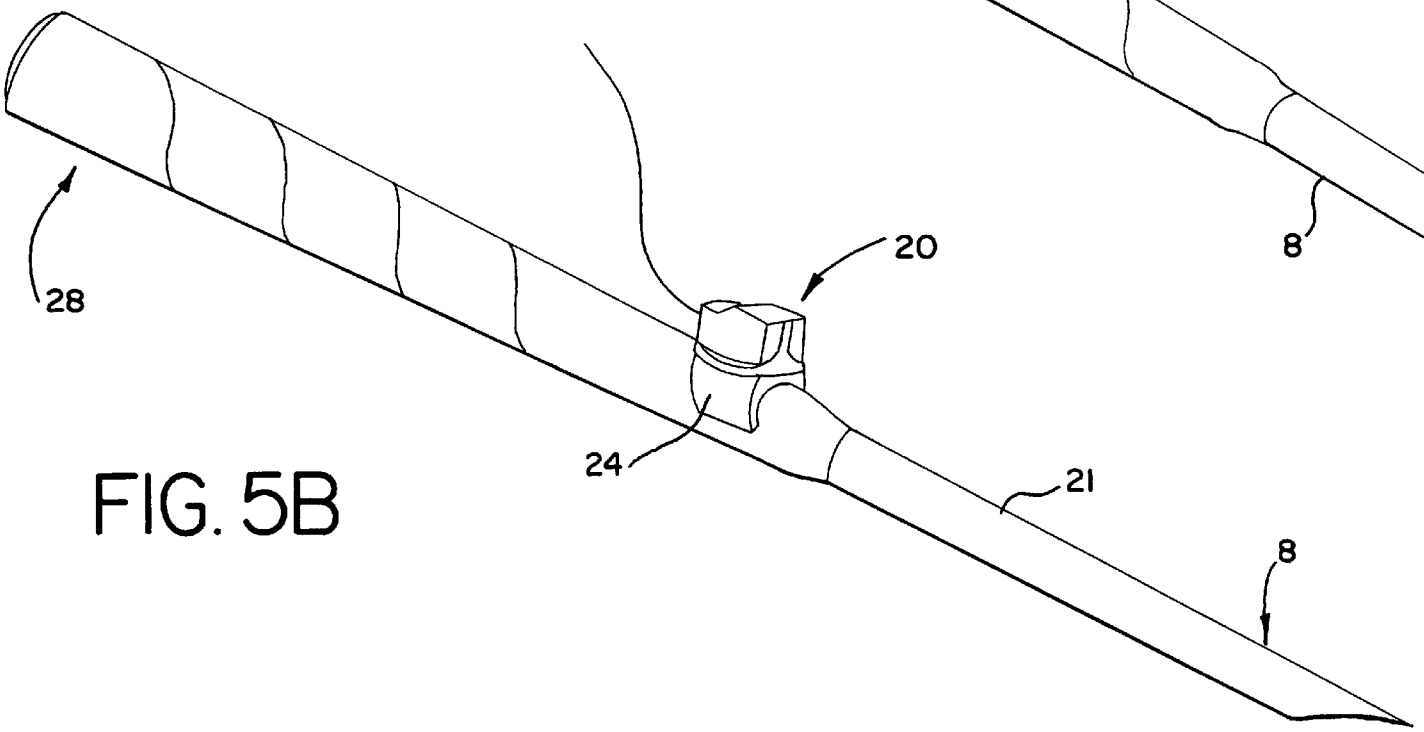
FIG. 5B shows the golf club sensor of FIG. 5A when attached to a golf club.

A final sensor 20 is attached to golf club 8 at the handle, separate from the shaft 21 and clubhead 23. Of course sensor 20 may be attached to other areas of club 8, such as shaft 21 or clubhead 23 without departing from the spirit of the invention. As seen in FIGS. 5A–B, golf club sensor 20 is attached by an adhesive to a base 22 formed with a pair of prongs 24. Prongs 24 define a space 26 into which handle 28 of golf club 8 is inserted. Prongs 24 define a snap fit with club 8. Golf club sensor 20 is also attached to golf club 6 by strap 30 preferably made from a hook and loop attachment system, such as the system known by the name of VELCRO™.

When sensors 6 and 20 are properly attached they form a sensor array that can be used to accurately track the movement of the golf swing. Sensors 6 and 20 detect electromagnetic radiation emitted from radiation source 32. Preferably, source 32 emits magnetic fields along three mutually orthogonal axes which are then detected by six degrees of freedom sensors 6 and 20. Upon detecting the magnetic fields, these sensors 6 and 20 are capable of producing signals representative of their position and orientation in space. These positions in space can be represented by such well known coordinate systems, such as x,y,z cartesian coordinates, cylindrical coordinates, spherical coordinates and euler angles. Such a magnetic source and detector system is marketed under the name of The Flock of Birds™ made by Ascension Technology Corporation of Burlington, Vt. Ascension Technology Corporation is also the assignee of a magnetic source and detector patent—U.S. Pat. No. 4,849,692, whose entire contents are incorporated herein by reference.

The signals generated by sensors 6 and 20 are sent by wires 34 to a system control unit 12 which (i) converts the signals to readings indicative of each sensor's position and orientation and (ii) sends such readings to an analyzer, such as computer 36. Other ways for sending the signals to system control unit 12 are also possible, such as radio-frequency (RF) transmissions sent by a transmitter in each sensor 6, 20 to a radio receiver connected to computer 36.

Figure 6:
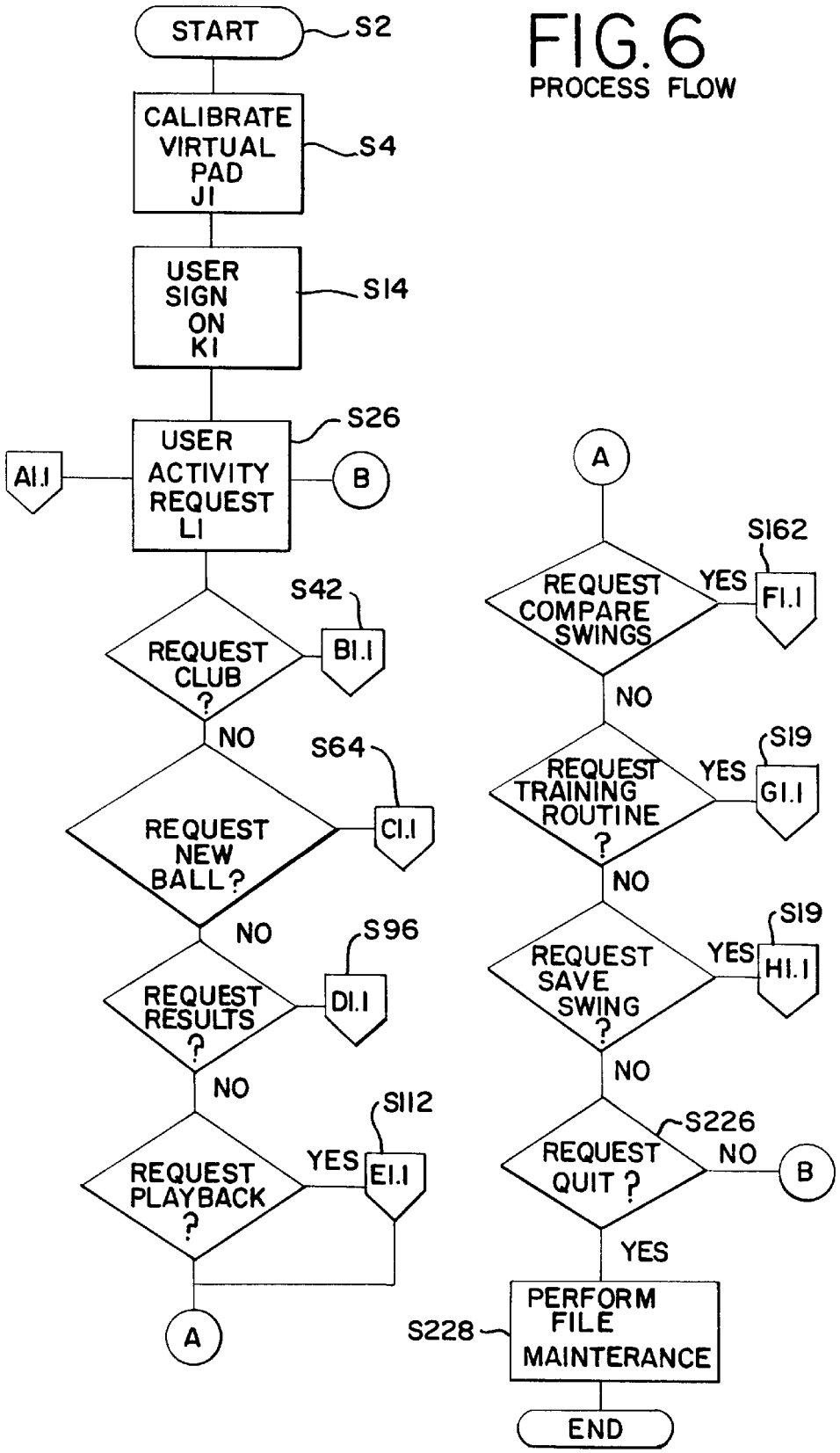
FIG. 6 shows a general flow chart for operating the golf swing analysis system of FIG. 1.

These signals are then processed by computer 36 according to the flow chart diagrams of FIGS. 6–18. FIG. 6 shows the general path of instructions followed by an operator of the system. The first step in operating the system is to turn on computer 36 which is attached to a display, such as video monitor 38 (S2). Once turned on the golfer needs to calibrate (S4) the position of control pad 4 since touching of various areas of control pad 4 is used to control various instructions performed by computer 36.

Figure 3:
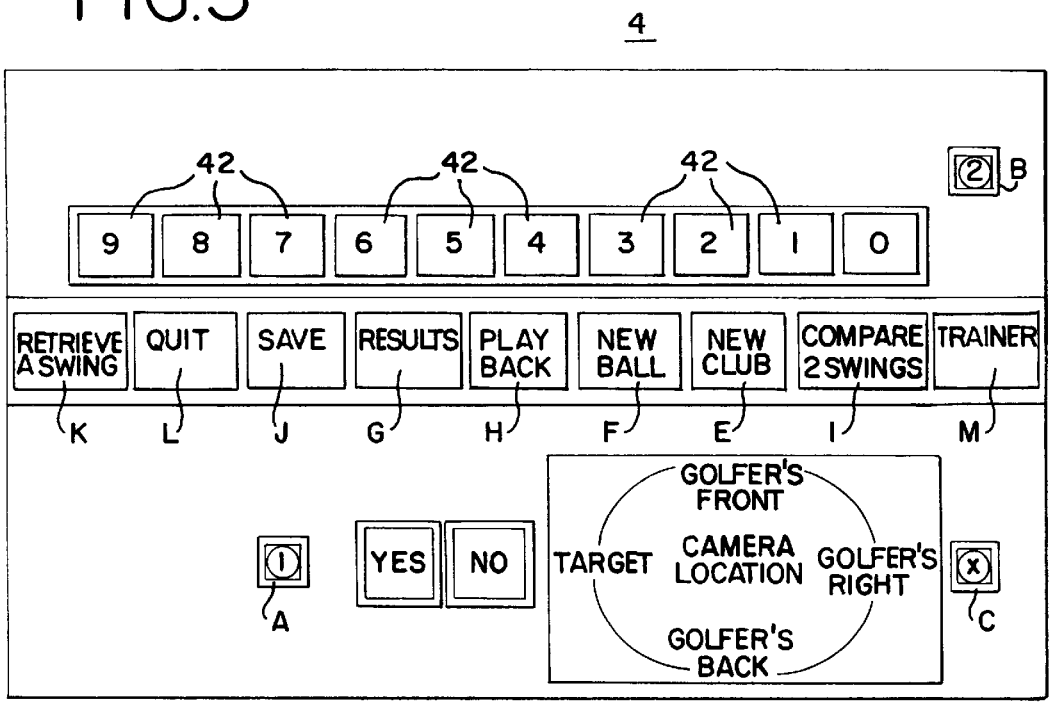
FIG. 3 shows a top view of a control pad used in the golf swing analysis system of FIG. 1.
Figure 4:
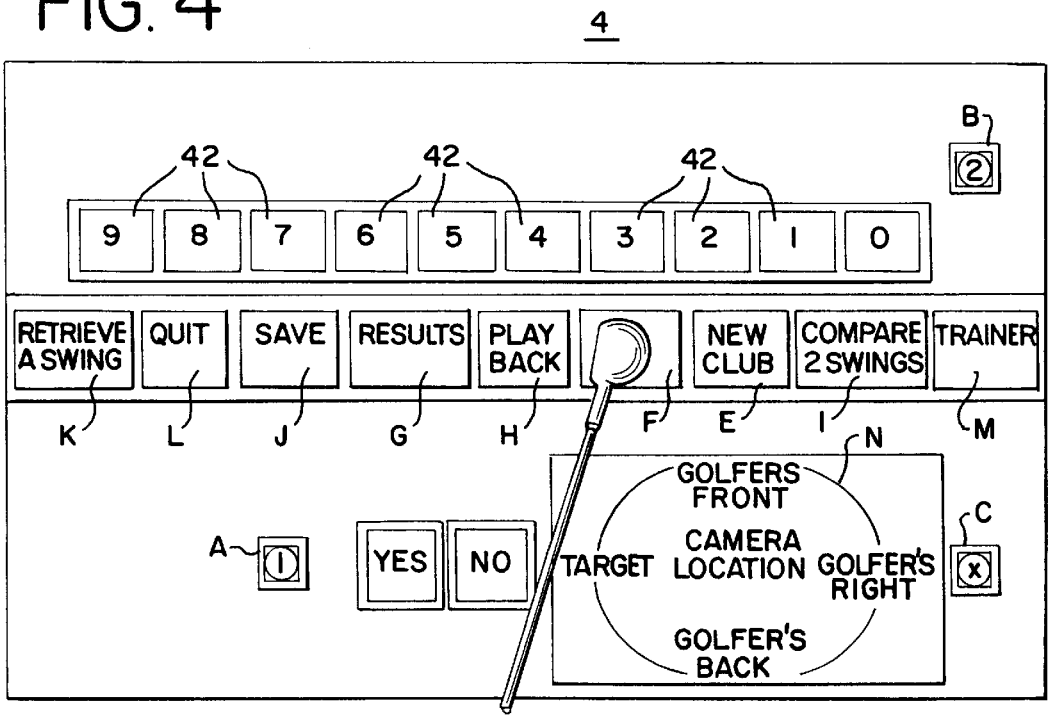
FIG. 4 shows a golf club operating the control pad of FIG. 3 according to the present invention.
Figure 7:
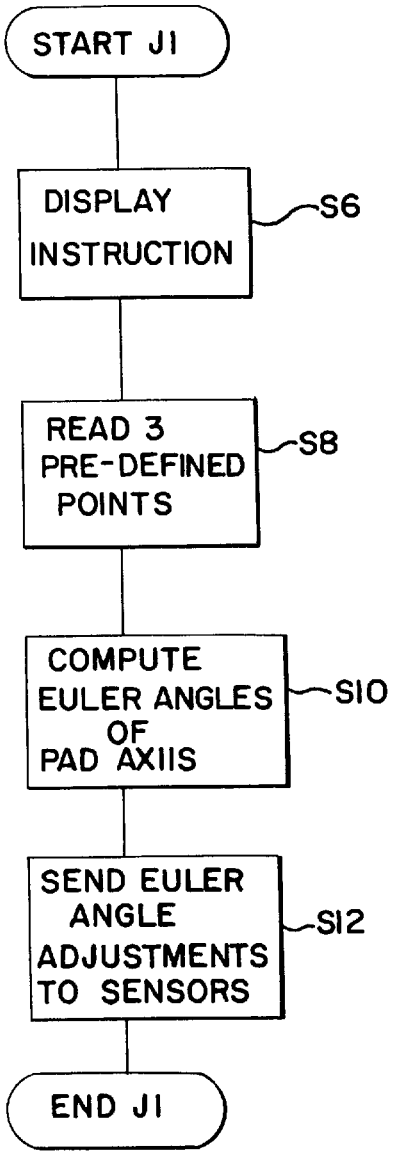
FIG. 7 shows a flow chart for the calibration of the control pad according to the present invention.

As seen in FIG. 7, during the calibration step (S4) monitor 38 instructs the golfer to place golf club sensor 20 at three predetermined points A, B, C on control pad 4 (S6), as seen in FIGS. 3 and 4. Once golf club sensor 20 is placed at one of the three predetermined points, the three dimensional coordinates of that point on control pad 4 relative to the source-sensor coordinate system are calculated from the detected position of golf club sensor 20. The coordinates measured may be either x,y,z coordinates, cylindrical or spherical coordinates, cylindrical coordinates. With the coordinates of the three points on the pad measured, it is possible by well-known mathematical techniques to extract the orientation, as measured in Euler angles, of pad 4, relative to the source-sensor coordinate system (S10).

At this stage in the process it is important to keep in mind that a golf swing is typically analyzed with respect to the flat ground from which golf ball 2 is struck. Accordingly, computer 36 calculates a transformation matrix that when applied to the three dimensional coordinates read by sensors 6 and 20 will rotate the readings so that they are reported to system control unit 12 relative to the control pad's orientation in space (S12). This coordinate system is known as the swing coordinate system.

Furthermore, since the location of all points on control pad 4 are known relative to the three points, A,B,C, computer 36 is able to determine the position of all points of control pad 4 in space. Those positions are stored in computer 36.

Figure 8:
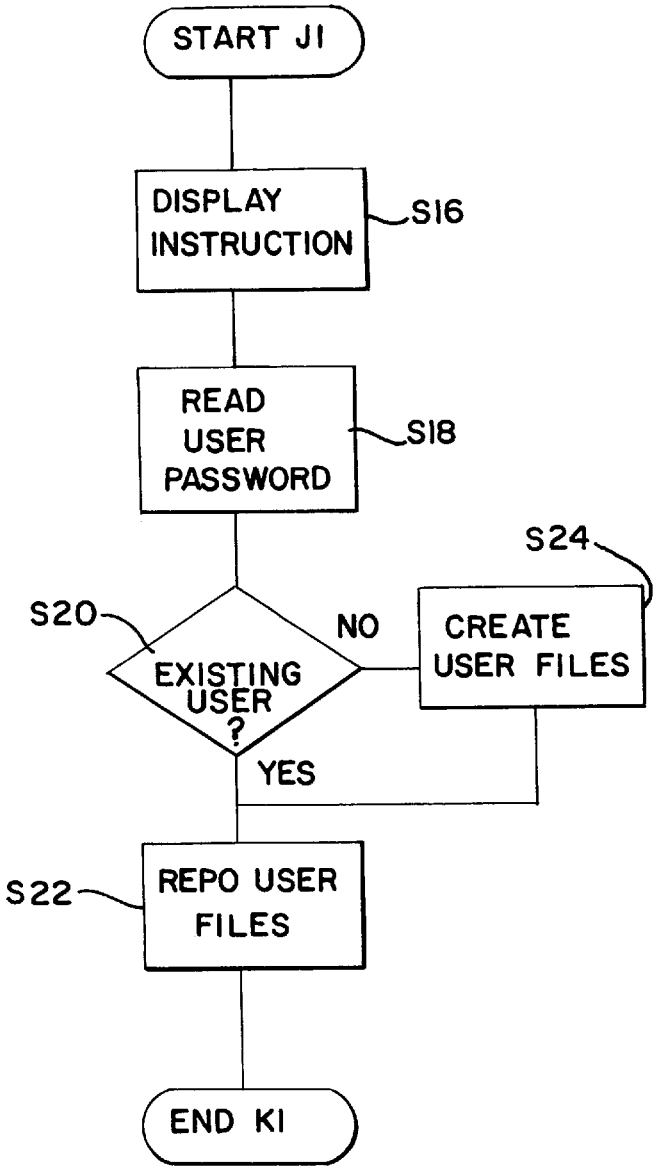
FIG. 8 shows a flow chart for a sign-on program according to the present invention.

After the calibration has been completed, the golfer may sign onto the golf swing analysis system (S14) as shown in FIGS. 6 and 8. As shown in FIG. 8, the sign-on program begins by first displaying an instruction on monitor 38 requesting the golfer to type in his or her password on keyboard 40 (S16). The computer then reads the password (S18) and compares the password typed in with a stored file of previously typed in passwords (S20). If the typed in password matches one of the stored passwords, computer 36 reads a user file previously compiled which corresponds to information regarding the golfer (S22). However, if the typed in password does not match the stored passwords, the typed in password is added to the stored file of passwords and a user file is created for the golfer (S24).

While the password is preferably entered via keyboard 40, it is within the spirit of the invention to use control pad 4 to enter the password. In such a case, all of the letters of the alphabet are placed on pad 4 and the golfer moves the clubhead of a club that has been previously selected and calibrated to those letters on control pad 4 that spell the password.

Figure 9:
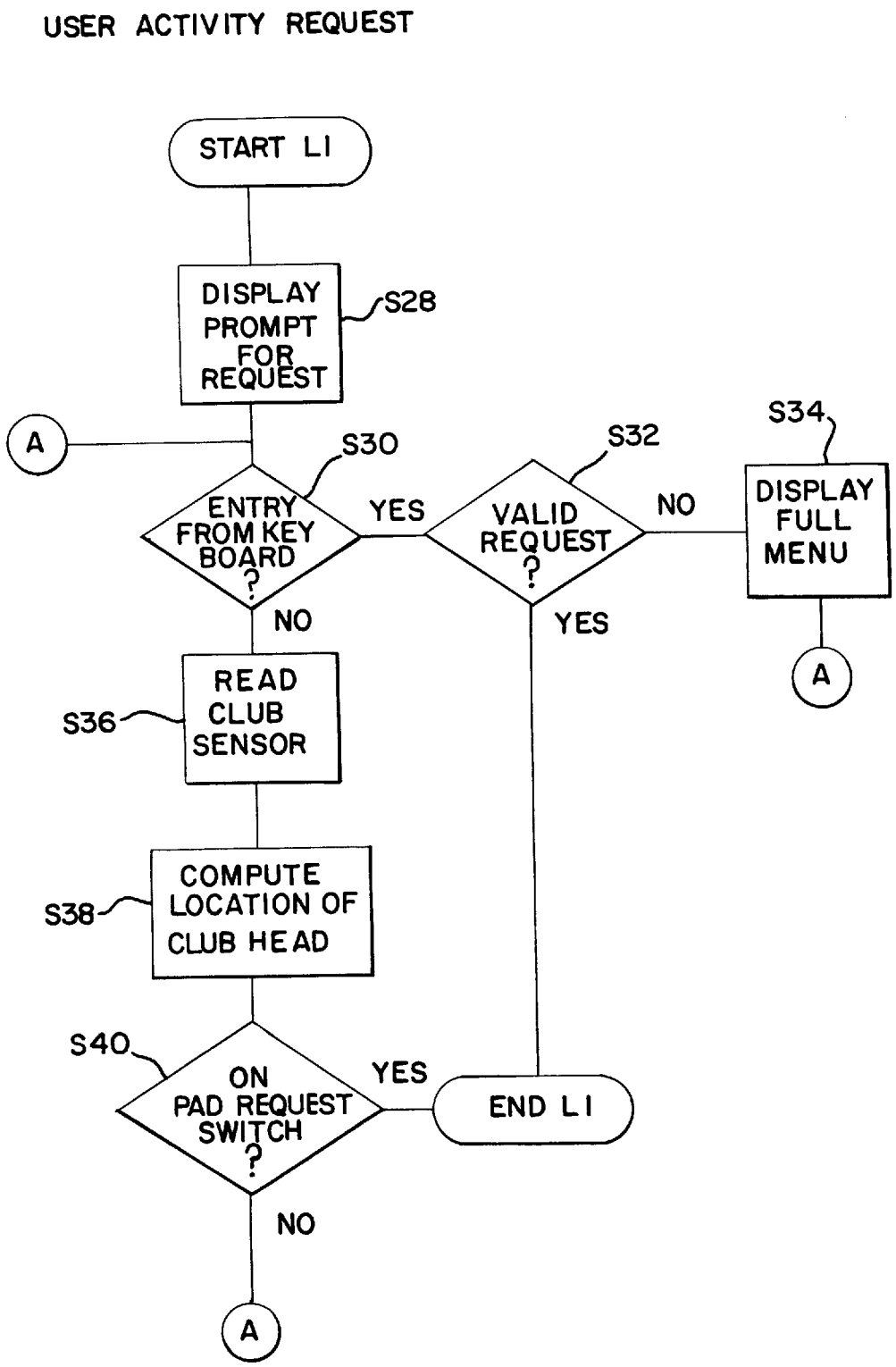
FIG. 9 shows a flow chart for validation program according to the present invention.

As seen in FIGS. 6 and 9, once the golfer has typed in his or her password as described above, computer 36 displays a prompt listing all possible activities that the golfer can choose (S26). As seen in FIG. 6, eight requests are possible and will be discussed in more detail below. Each request is initiated by either typing one or more words on keyboard 40 or, if a club has previously been selected and calibrated, by positioning clubhead face 25 at one of nine areas E–M on control pad 4 that corresponds to the request typed in on keyboard 40. After a request is made the validation subroutine of FIG. 9 is performed. The first step in the subroutine is to have computer 36 determine if the request was made by keyboard 40 (S30). If it was, computer 36 determines if the keyboard request is valid (S32). If the keyboard request is invalid, the one or more requests are again displayed on monitor 38 (S34) and the process of selecting a request is repeated. If keyboard 40 is not employed to enter a request, then computer 36 reads the detector signal from club sensor 20 (S36) and calculates the position of clubhead face 25 in a manner described subsequent in (S62). Computer 36 then compares the position of clubhead face 25 with predetermined positions on the pad that correspond to the requests (S40). If the clubhead position is invalid, then the process of selecting a request is repeated.

If clubhead 23 is located at one of the areas E–M or the proper request has been typed in on keyboard 40, then the request is performed. For example, as seen in FIGS. 3, 4, 6 and 10, by positioning clubhead face 25 within area E, labeled "NEW CLUB," one may request a certain new club 8 to be selected for a swing analysis (S42). Club 8 may include 1, 3, 4, 5 woods and 1–9 irons. If the club request is properly made according to the subroutine of FIGS. 10A–B, the monitor displays a prompt requesting the menu number corresponding to club 8 to be selected (S44). The menu number can be selected by either typing it in on keyboard 40 or by positioning clubhead face 25 to one or more predetermined numbered areas on control pad 4. As seen in FIGS. 3 and 4, nine areas 42, labeled as numerals 0–9, are placed on control pad 4 to allow for selection of a menu number. For example, if a three wood corresponds to menu number "22," the user would then touch the area labeled "2" twice to select the three wood.

Computer 36 first determines whether the number is entered by keyboard 40 (S46). If keyboard entry is detected, then computer 36 compares whether the number is a valid request (S48). An error message is displayed on monitor 38 when the number is not valid (S50). The golfer then corrects the error by retyping a valid menu number. Once the typed in number is verified to be valid according to the process described above, computer 36 records the club corresponding to the valid menu number (S52).

A similar procedure is performed if club 8 is selected by using control pad 4. The clubhead is moved to one of the club selection areas 42 on control pad 4 corresponding to the menu number to be selected. At the numbered position 42, computer 36 reads the position signal from club sensor 20 (S54) and calculates the position of clubhead face 25 in a manner described below (S62). Computer 36 next compares the calculated clubhead position with a set of stored positions for the numbered pad positions 42(S58). If the calculated clubhead position does not match one of the stored positions, the computer 36 checks to see if a menu number has been entered on the keyboard 40 as described above. If no keyboard entry has been made, the clubhead face position is checked again (S54, S56). this process of checking between the keyboard 40 and the control pad 4 is continued until a valid number is recognized.

Figure 10A:
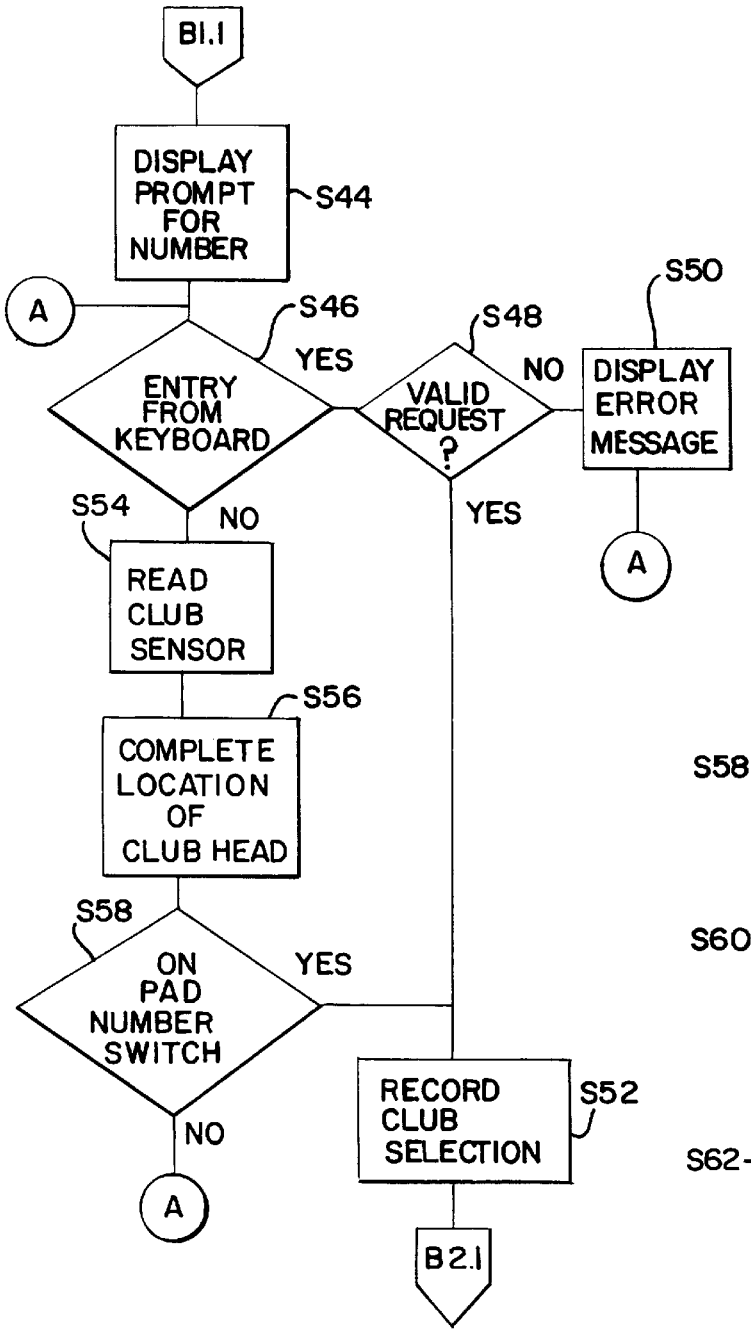
FIGS. 10A–B show a flow chart for a club request program according to the present invention.
Figure 10B:
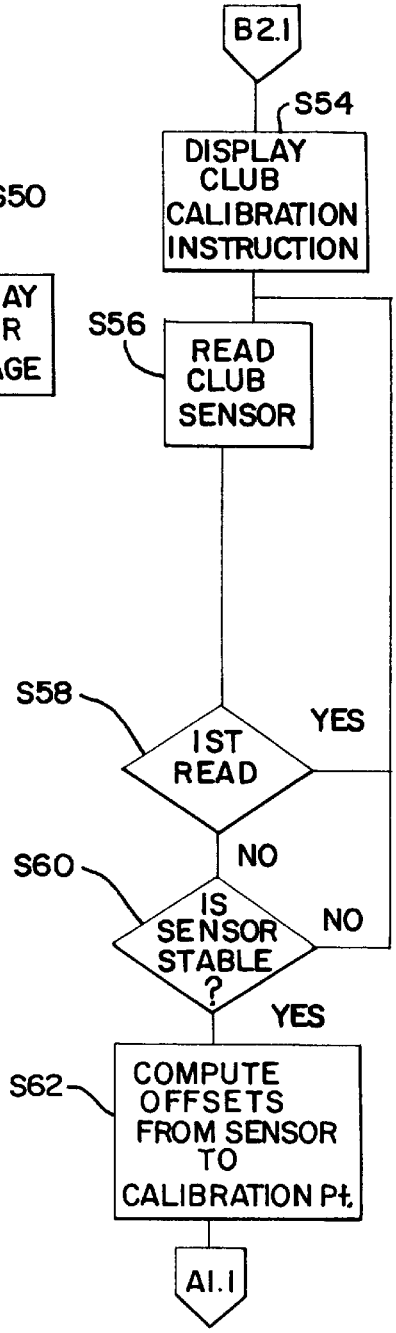

Once club 8 has been selected and recorded by computer 36, the monitor 38 displays instructions for calibrating the club sensor 20 (S54), as shown in FIG. 10B. The monitor 38 instructs the golfer to (1) attach golf club sensor 20 to the newly selected club, (2) place the club face 25 on the designated calibration point C on control pad 4, (3) hold the club face 25 on point C for a predetermined amount of time, such as 1 second. The computer 36 then reads the signals from club sensor 20 (S56) a pair of times (S58). The signals are measured and compared with each other (S60) to see if they are within a predetermined tolerance level of each other, such as 0.25". Once the signals are within the tolerance level, the club sensor 20 is considered stable and the club face 25 is assumed to be resting on calibration point C. If the two signals are not within the tolerance level, the calibration process is repeated until the signals are within the tolerance level. When the club sensor 20 is stable, its x,y,z coordinate position and its orientation as measured by its rotation matrix are recorded and stored in the computer 36. Given the x,y,z coordinate position of the sensor and its rotation matrix together with the x,y,z coordinate position of the club face 25 at the time of the sensor reading (known by its location on the known calibration point C), it is possible by algebraic means to calculate the x,y,z offsets from the club sensor 20 to the club face 25 (S62). As long as the club sensor 20 remains fixed to the club 8, these offsets can be used to derive the location and orientation of the club face 25 for any subsequent club sensor 20 position and orientation.

After the club sensor 20 has been calibrated, the golfer is now ready to analyze his or her swing while using the selected club 8. The golfer first sets or tees the golf ball 2 in any convenient location on or off control pad 4. As seen in FIG. 1, control pad 4 may also include a tee 43 for teeing up the ball 2.

Figure 11A:
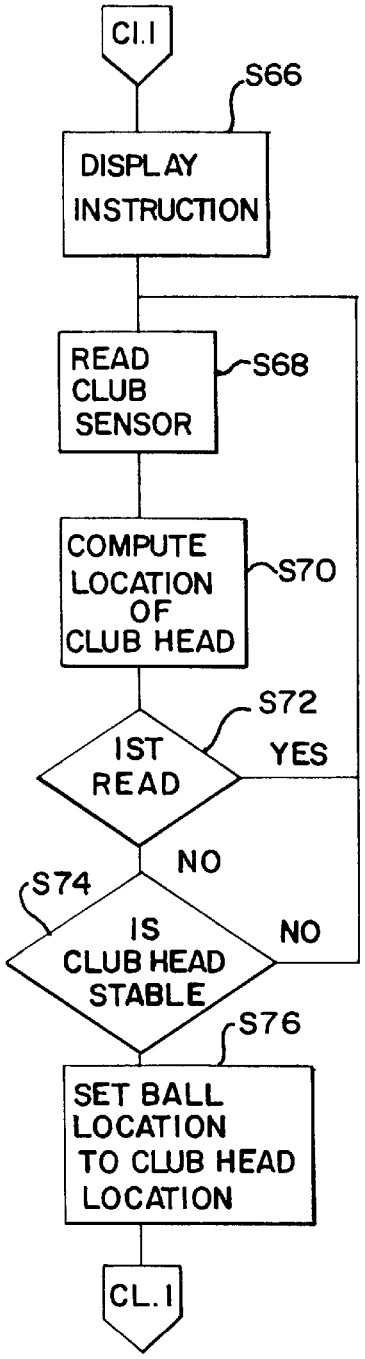
FIGS. 11A–B show a flow chart for a ball location program according to the present invention.
Figure 11B:
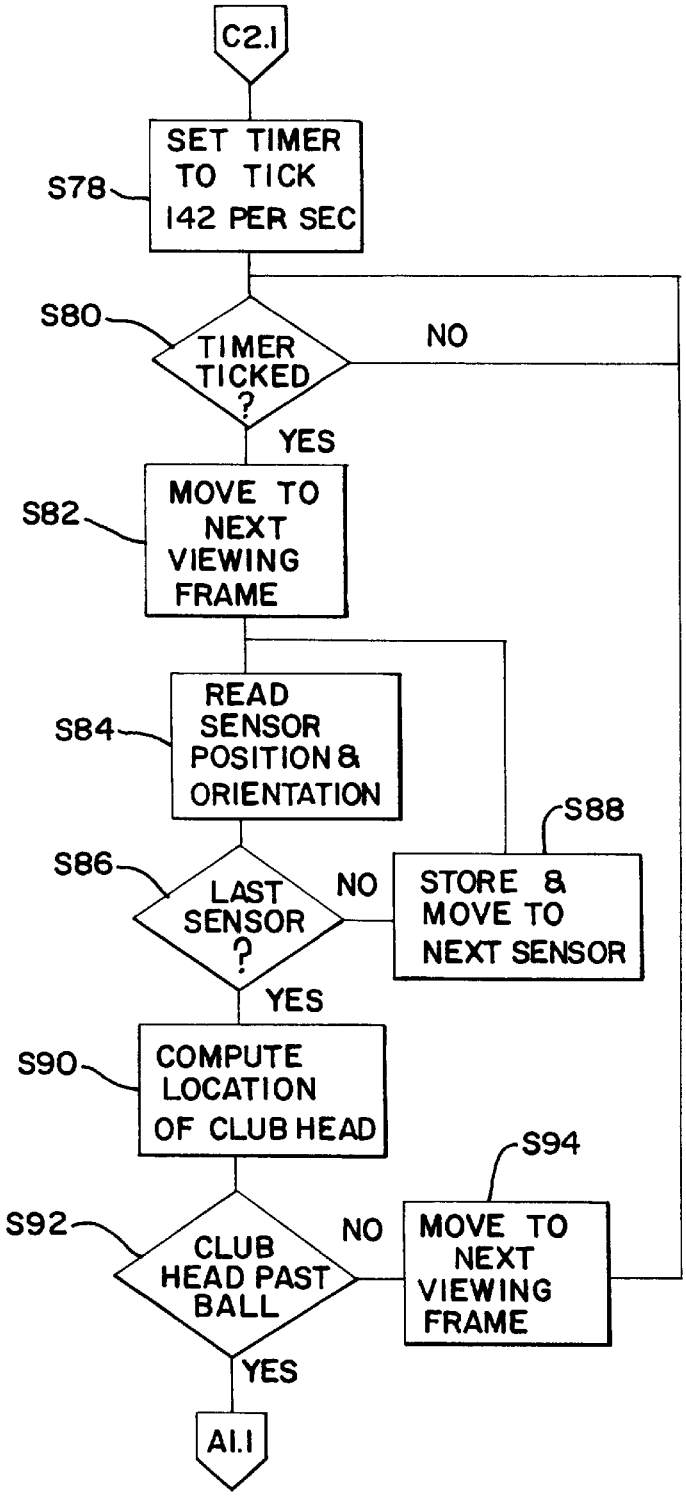
Figure 12:
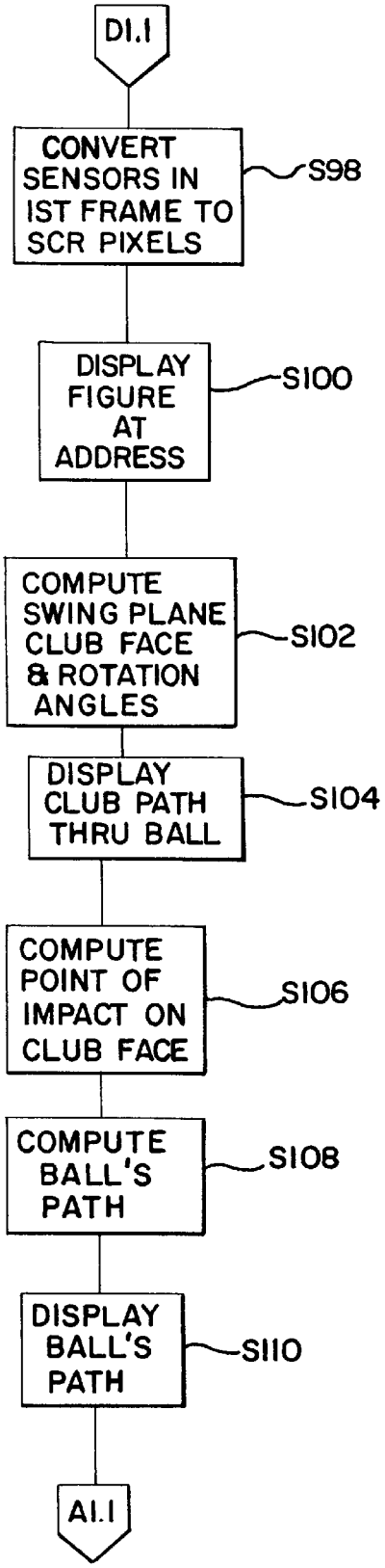
FIG. 12 shows a flow chart for a flight of the ball program according to the present invention.

Once the golf ball 2 is positioned, the golfer moves the clubhead to area F of control pad 4 labeled "NEW BALL." As described previously, computer 36 calculates the clubhead position and compares the calculated position with the stored position of the "NEW BALL" area. If the positions match, then the ball location subroutine (S64) of FIGS. 6 and 11A–B is performed to determine the position of the golf ball 2. Monitor 38 displays an instruction to the golfer to address the ball 2 by placing the club face 25 directly next to the ball 2 and square to the intended flight path of the ball (S66), as shown in FIGS. 1 and 2. The computer 36 then reads the signal from the club sensor 20 (S68) and calculates the location of the clubhead face 25 (S70). This process is repeated to produce a second calculated clubhead face position (S72). The two calculated clubhead positions are then compared with each other to see if they are within a predetermined tolerance level of each other, such as 0.25". Being within the tolerance level helps insure that clubhead face 25 is stable and the calculated position of the golf ball 2 will be accurate. If the tolerance level is not achieved, the process is repeated until it is (S74).

When the clubhead face 25 is stable, the ball position can be calculated in a well-known manner taking into account that the club face is next to the golf ball 2 and the dimensions of the golf ball are known (S76). The calculated ball position and the position and orientation readings of the club sensor 20 are then stored in computer 36.

After the golfer addresses the golf ball 2, he or she swings the club 8 to hit the golf ball 2. During the swing, each of the sensors 6 and 20 worn by the golfer and attached to the golf club continuously send position signals to computer 36. As indicated by FIG. 11B, computer 36 has a sampling clock that samples each of the sensor signals at a rate of approximately 142 times or frames per second (S78). This high sampling rate is necessary to accumulate a sufficient number of frames of information to form a simulated moving picture that adequately represents the actual swing.

To form the simulated moving picture, computer 36 samples the sensor signals at the start of each clock signal (S80, S82). A frame of information is accumulated at the start of each clock signal by having the computer sequentially read the signals from each sensor worn by the golfer and attached to the golf club 8 (S84, S86, S88). The positions of the sensors are stored in a memory of computer 36 and represent a single frame of position information.

Besides recording the position of each of the sensors, computer 36 also calculates the position of the clubhead face 25 during each frame (S90). The computer then compares the position of the clubhead face 25 with the initial position of the ball 2 (S92). If the computer determines that the clubhead has not moved past the ball's initial position, then another frame of position information is obtained at the beginning of the next clock signal (S94). Frames of position information are continually taken and stored in this manner until computer 36 determines that the clubhead has moved past the golf ball's initial position. Thus, position information from address to backswing to impact is stored. Of course, position information for the follow-through can be obtained by using a timer to store frame information up to a predetermined time past impact. The frames of position information are stored in a file corresponding to the golfer's password entered previously.

From the stored frames of position information, many studies of the golfer's swing are possible. For example, the flight of the golf ball 2 can be determined by analyzing the impact of the clubhead with the golf ball 2. This is accomplished by first taking the clubhead face 25 and touching area G, labeled RESULTS, on control pad 4. The computer then performs the subroutine of FIGS. 6 and 12 (S96). The subroutine begins with the computer 36 taking the stored position information for the sensors 6,20 of the first frame taken at the address of the ball and converting the information for each sensor into corresponding pixel information to be displayed on monitor 38 (S98). The pixels for the first frame are connected so as to form a stick figure holding the selected club at the address position (S100). Forming such a stick figure from three dimensional coordinates is well known in the art. The stick figure formed for the first frame is displayed on monitor 38. The stick figure displayed can be replaced with the image of a person holding a club as well. The computer then converts the previously stored club position from each frame to a pixel representation. The pixel information for each frame is then displayed sequentially over the stick figure to show the movement of the club 8 and clubhead 23 in space from the top of the swing to impact through the ball 2 (S100). This display shows the shape of the swing plane of the club 8.

Given the clubhead face 25 position, the club sensor 20 position and orientation and the location of the ball 2, it is possible to compute all of the relevant data at the point the club face 25 impacts the ball 2. The club sensor and clubhead face readings before and after impact are interpolated in linear fashion to the point of intersection with the ball. The angle which the swing plane creates with the target line and the angle the club face creates with the target line can then be calculated directly from the position and rotation matrices of the club sensor 20. Alternatively, the angles can be calculated by application of trigonometry to the two club face readings surrounding impact (S102). Control of these angles is critical to controlling the flight of the ball and are hence displayed graphically and statistically as a means of providing feedback to the user (S104).

In addition to the angles of impact, location of impact on the club face is an important determinant of ball flight. Thus a determination of where on the club face impact occurs is made by direct comparison of the ball coordinate position with that of the club face (S106). The ball's flight is then computed from statistical equations fit empirically by multiple regression techniques (S108). This flight path is shown graphically together with information on the distance of the ball's flight and distance left or right of target (S110).

Figure 13:
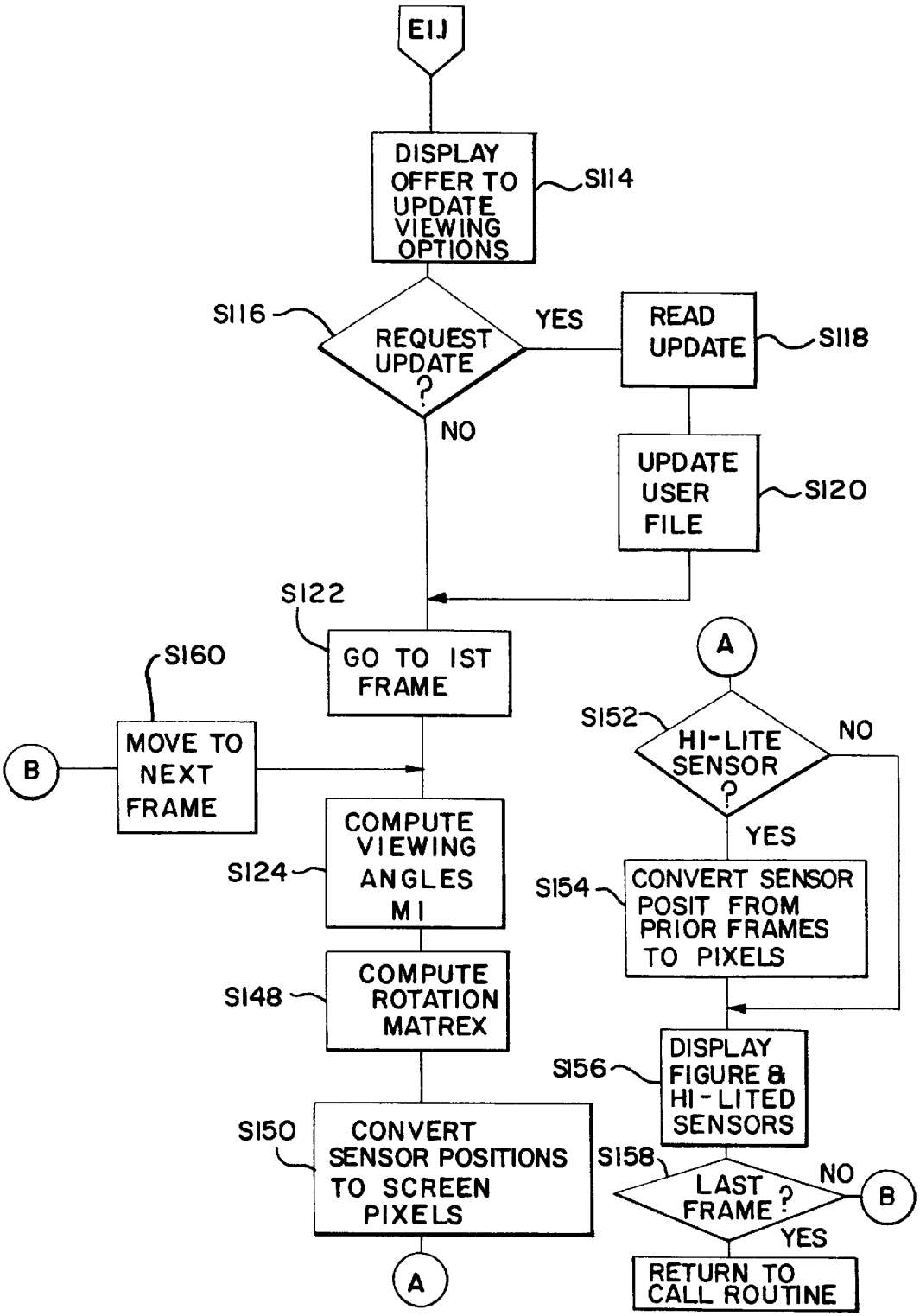
FIG. 13 shows a flow chart for a replay program according to the present invention.
Figure 14:
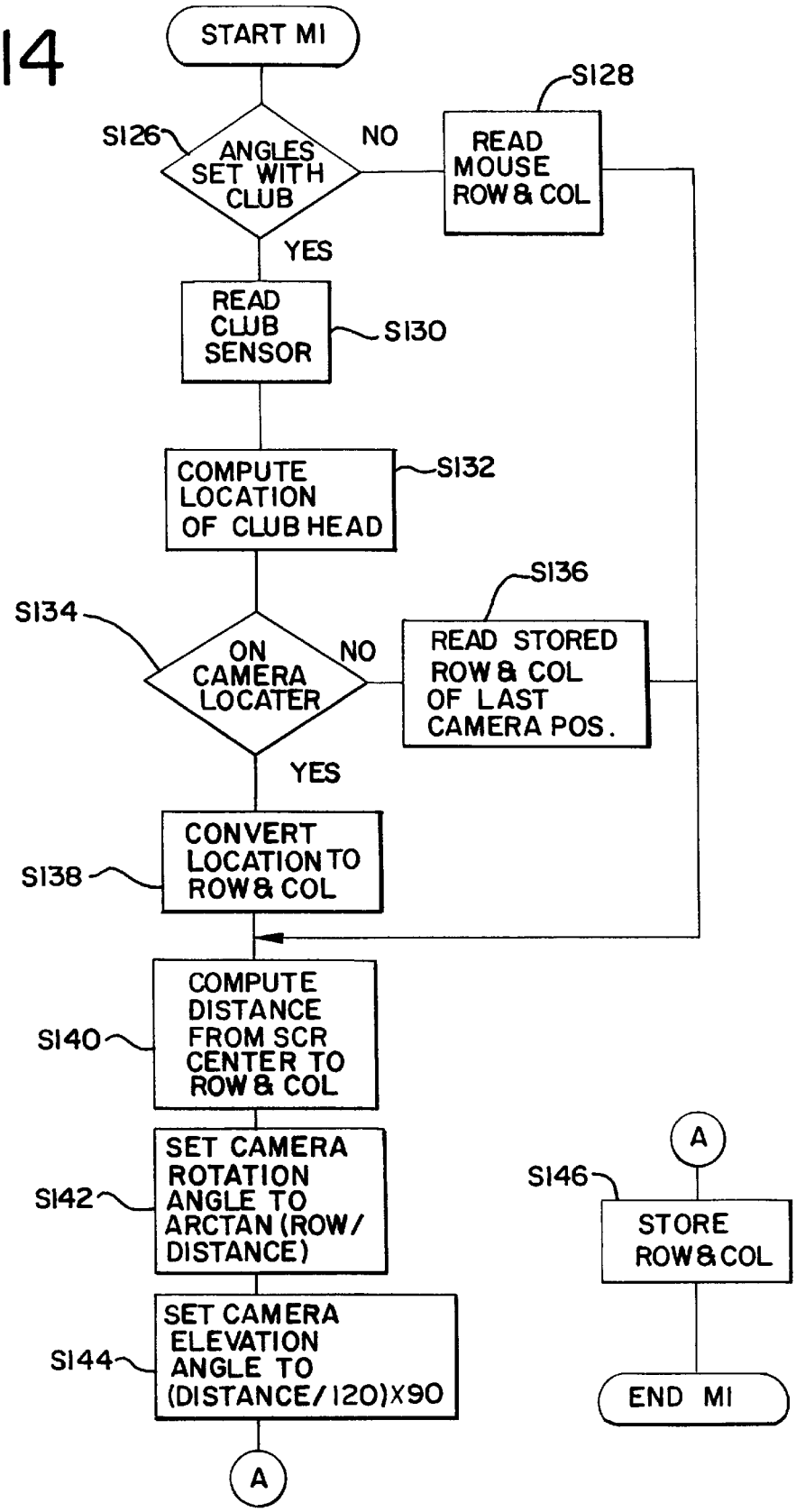
FIG. 14 shows a flow chart for a viewing angle program according to the present invention.
Figure 15:
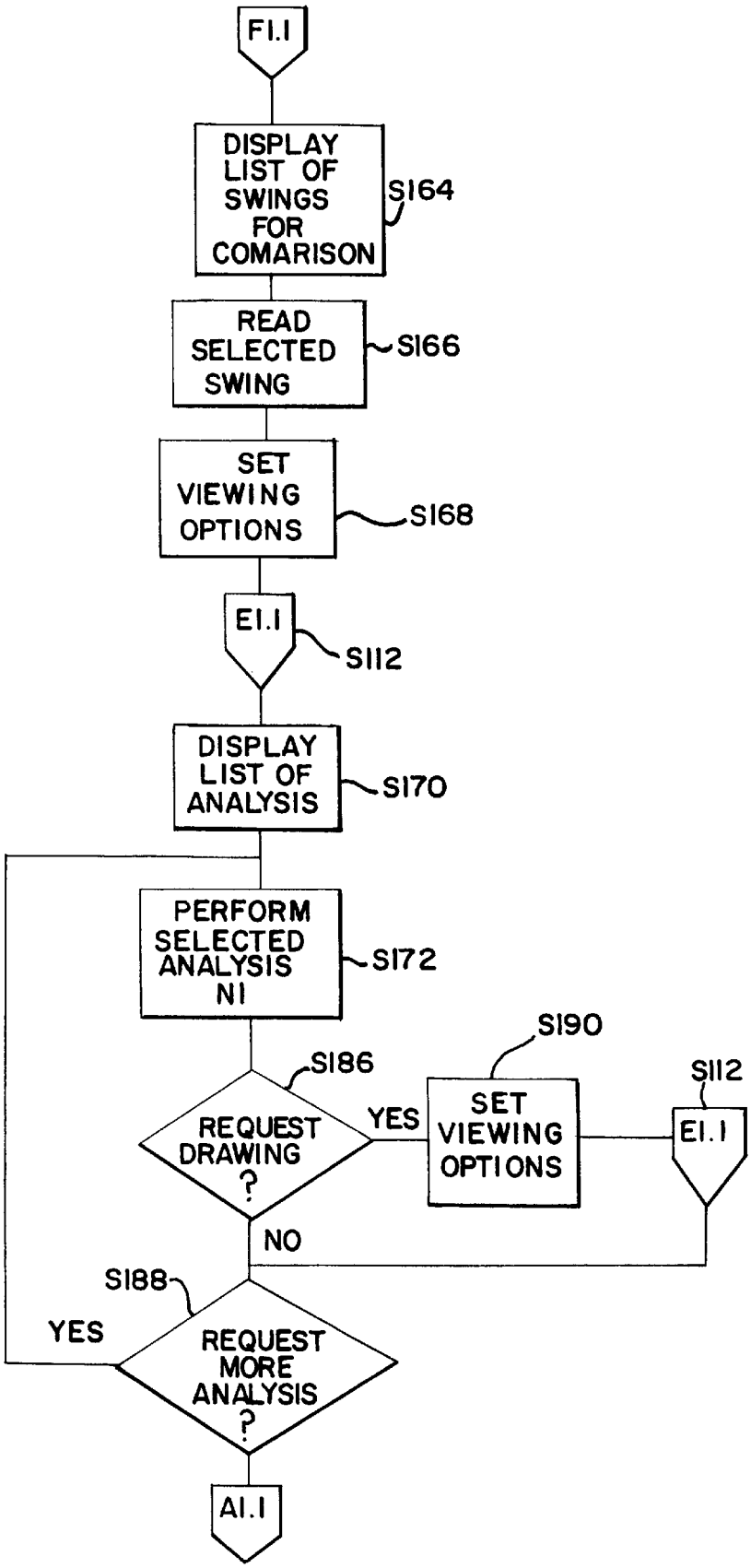
FIG. 15 shows a flow chart for a comparison of swing program according to the present invention.

After viewing the results of his or her swing, the golfer may wish to play all of the frames of the swing and view it from one or more viewing angles. As shown in FIGS. 6 and 13, after the golfer moves club face 25 to area H labeled "PLAYBACK" on control pad 4, a playback subroutine is performed (S112). Initially the subroutine displays a message on monitor 38 prompting the golfer to update the viewing options, such as highlighting the club 8, the method for setting the viewing angle, reversing the play of the image and the speed at which the image is played (S114). This yes or no response can either be typed in or indicated by moving the club to the "YES" or "NO" areas on control pad 4 (S116). If the player opts to update the viewing options, he or she enters menu selections from either the keyboard 40 or control pad 4, the computer reads the updated viewing option (S118) and stores the updated viewing option in the golfer's file (S120). The computer 36 then calls up the first frame of position information (S122). At this moment, computer 36 transforms the positional information so that different views of the swing can be observed on the viewing monitor 38. The computer performs this transformation by first implementing the viewing angle program of FIG. 14 where the desired viewing angle is calculated (S124). The computer 36 first determines which method for setting viewing angles has been stored on the golfer's viewing option file. If the mouse 44 is used to choose the viewing angle, the computer 36 reads the position of the mouse cursor by row and column as defined on the screen of monitor 38 (S128). If the clubhead face 25 controls the viewing angle, the computer 36 reads the signal from club sensor 20 (S130) and computes the location of the clubhead face 25 (S132). Computer 36 then compares the calculated position of the clubhead face 25 with the stored positions of the control pad 4 and determines whether the clubhead face 25 is positioned within the circular camera locator area N on pad 4 (S134). If the clubhead is determined to be outside area N, then the last camera position in terms of row and column is read from the golfer's viewing option file by computer 36 (S136). If the clubhead is within area N, then the clubhead position is converted into an equivalent row and column position on the screen of monitor 38 (S138). The computer 36 next computes the distance, d, between the center of the screen and equivalent location of either the clubhead or mouse 44 position (S140). This distance, d, is used to calculate the angle, θ, in which the viewing angle is rotated according to the formula $\theta=\sin^{-1}$[row of clubhead/d] (S142). The camera elevational angle, ϕ, as measured from the z-axis is determined from the equation $\phi=[d/120]\times 90°$ (S144). The camera location (row and column) is then stored for use in later frames (S146).

As seen in FIG. 13, computer 36, with the calculated angles θ and ϕ, computes a rotation matrix in a well-known manner to rotate the original positional information of the sensors. After the computer 36 rotates the original positional information, the computer converts the rotated information into pixel information so that it produces the desired view of the golfer to be displayed on monitor 38 (S150, S156).

At this stage, computer 36 determines the viewing option file if any of the sensors 8, 20 are to be highlighted on the monitor 40 (S152). If any sensors are to be highlighted, computer 36 converts the stored sensor positions from all prior frames into pixel information (S154) and displays the pixels on monitor 38 corresponding to the sensor positions in a bright color. The computer 36 then constructs a stick figure of the golfer and the club 8 together with the highlighted sensors from previous frames (S156).

Computer 36 repeats this process for all of the other frames of position information and sequentially displays each of the transformed frame information on monitor 38 (S158, S160). The result is that the golfer is able to view his or her swing from several points of view, such as from the golfer's front and back, above the golfer, toward and away from the target. Highlighting the sensor positions on the monitor 38 provides the additional advantage of letting the golfer concentrate on the movement of particular joints during the swing.

Another tool in analyzing the golfer's swing is to compare two or more swings with each other to see any differences from one swing to another. For example, comparing a good swing with a bad swing can give the player clues how to correct bad habits in his or her swing. This comparison is accomplished by having the computer perform the steps shown in FIG. 15 by positioning the clubhead at the "COMPARE 2 SWINGS" area I of control pad 4. The computer 36 then displays a menu list of swings that have been previously saved by the golfer who is presently signed onto computer 36 (S164). In another embodiment, all swings stored in computer 36 are displayed for comparison purposes. The player then selects one of the stored model swings by entering the menu number from either keyboard 40 or control pad 4. These stored swings may be an ideal swing preformed by a professional or a good swing made by the golfer which he would like to repeat. Computer 36 then downloads the positional information for the current swing (S166) and the selected swing and then sets the viewing options by retrieving the user's viewing option file (S168).

With the swings downloaded and the viewing options set, the computer then performs the playback program for each swing as described previously with respect to FIG. 13 (S112). The monitor 38 consequently displays both the selected stored swing and the current swing side-by-side at a desired point of view.

At this juncture, monitor 38 displays a menu of possible analyses for the swing (S170), such as:

1) Position at Address

2) Takeaway

3) Position at Top

4) Position at Impact.

Figure 16:
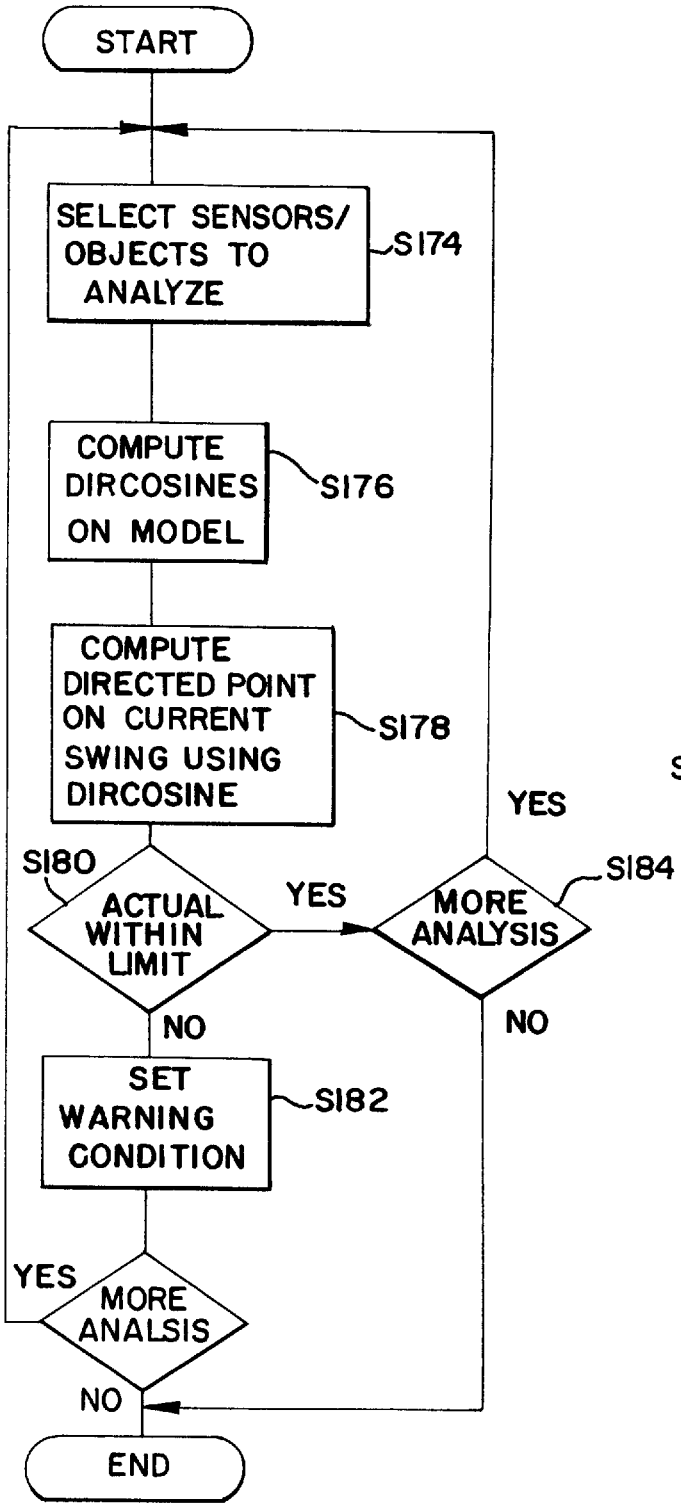
FIG. 16 shows a flow chart for an analysis of swing program according to the present invention.

The golfer selects one of the items on the menu resulting in the computer 36 performing the analysis program of FIG. 16 (S172). Based upon the particular analysis selected, computer 36 selects one or more sensors 8, 20 (or objects such as golf ball 2) of the selected image to be analyzed (S174). The sensors (or objects) are chosen in accordance with the criticality of the position of the object that the sensors measure. The sensors selected are summarized in the table below:

| Analysis | Object Measured | Sensor(s)/Objects |
|---|---|---|
| Address | club position | club sensor 20 and club face 25 |
| | hand position | hand and shoulder |
| | crouch position | knees and hips |
| | shoulder alignment | both shoulders |
| | hip alignment | both hips |
| | bending angle | hip and shoulder |
| | ball position | left shoulder and ball location |
| Takeaway | club position | club sensor 20 and club face 25 |
| | hand position | hand and shoulder |
| | shoulder alignment | both shoulders |
| | hip alignment | both hips |
| Top | club position | club sensor 20 and club face 25 |
| | hand position | hand and shoulder |
| | shoulder alignment | both shoulders |
| | hip alignment | both hips |
| | elbow position | right elbow and right shoulder |
| Impact | club position | club sensor 20 and club face 25 |
| | hand position | hand and shoulder |
| | crouch position | knees and hips |
| | shoulder alignment | both shoulders |
| | hip alignment | both hips |
| | bending angle | hip and shoulder |
| | ball position | left shoulder and ball location |

After the analysis is chosen, computer 36 calculates, for each frame relevant to the chosen analysis, the direction cosines for the stored swing as measured from one of the selected sensors, called the "reference object," to the other selected sensor (S176). These direction cosines are stored for each frame. Next, computer 36 reads the corresponding frames of the current swing and locates the sensors (or objects) that correspond to the reference object sensors of the stored or model swing. For each frame of the current swing, the stored direction cosines are applied to the located sensor to compute the proper position of the second sensor (S178). Computer 36 then determines whether the actual and calculated second sensor positions are within a predetermined tolerance level, such as 2" (S180). If they are not, a warning message is displayed on monitor 38 (S182).

There are several approaches to comparing the orientation of the model's pair of sensors to the current swing's pair of sensors. As explained above, the preferred approach is to compute the direction cosines from the first sensor on the model to the second sensor on the model. Using the direction cosines, the comparable position for the second sensor on the current swing can be computed by applying the direction cosines to the first sensor of the current swing. The position of the computed point and the position of the second sensor can then be compared to see if they are within certain limits. In a second approach, a vector joining the model's two sensors is computed. The vector is then reoriented and scaled to the length of the comparable vector on the current swing. Next, the computed vector and the comparable vector are subtracted to generate an error vector. The magnitude and/or the direction of the error vector can be compared to see if they are within certain predetermined limits.

Computer 36 then determines if all sensor pairs relevant to the selected analysis have been analyzed. If not, the process is repeated. When all sensor pairs have been analyzed control is returned to the calling routine (S184).

At this point the golfer may review the listing of warning messages which indicate differences in the alignment of objects in the current swing and the retrieved swing. For example, if the actual ball position was 4 inches to the golfer's right of the ball position as computed above, the corresponding warning message would be "Move ball 4 inches to the left." The warning list contains instructions to enter the menu number of any warning message for which the golfer wishes to see a drawing displayed on the monitor (S186). If the golfer makes such a selection, computer 36 retrieves the viewing options from the viewing option file, sets the first and last frame numbers relevant to the analysis and invokes the "PLAYBACK" routine discussed previously (S112).

At this point, the computer prompts the user for the selection of another analysis. If the golfer declines control is returned to the main menu (S188).

Only one pair of sensors is analyzed on each call to the analysis routine. If the sensor pair of the current swing is in alignment with the frame of the model swing (S214) another sensor pair is analyzed. This process is repeated until all of the sensor pairs of the address analysis described previously have been analyzed (S216).

Figure 17:
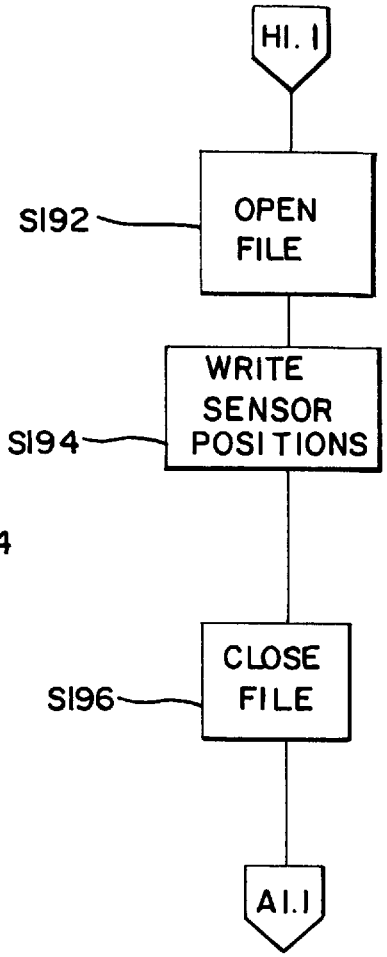
FIG. 17 shows a flow chart for a program for saving a swing according to the present invention.
Figure 18A:
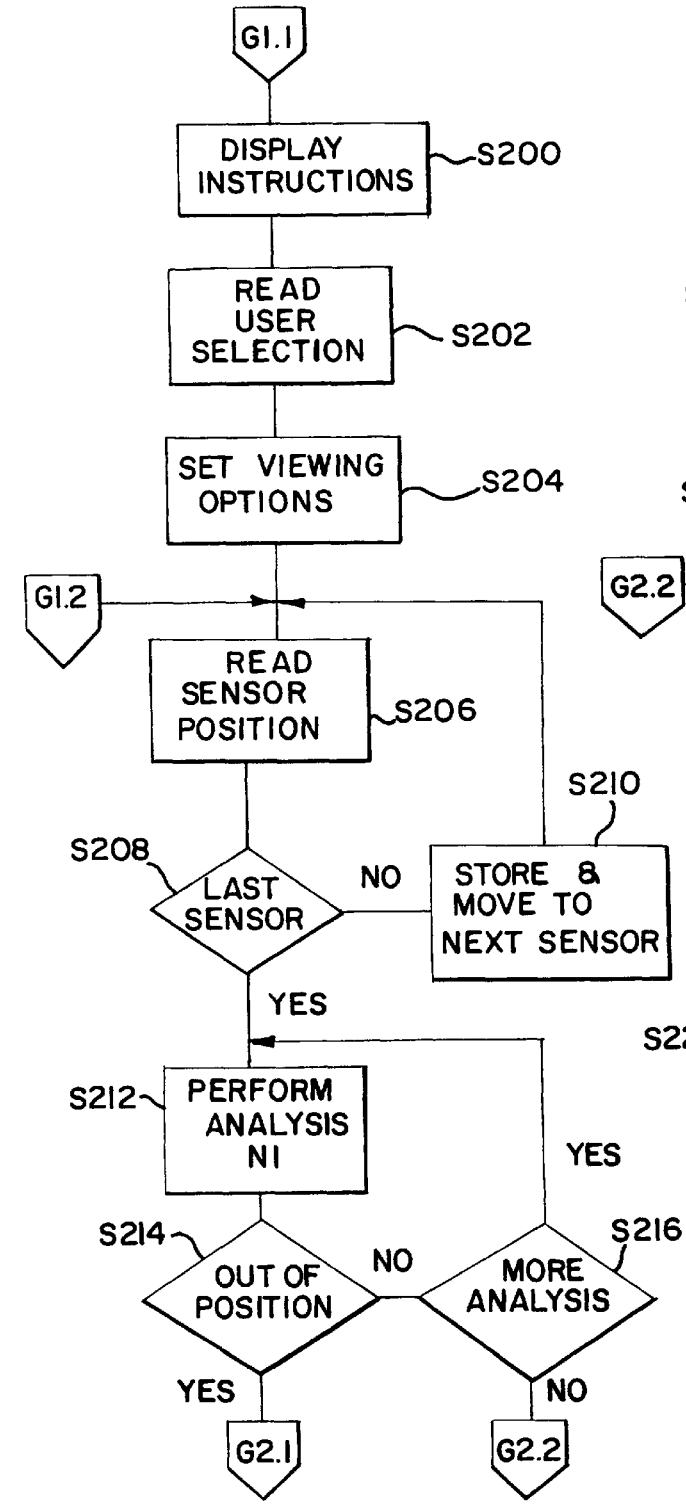
FIGS. 18A–B show a flow chart for an interactive training program according to the present invention.
Figure 18B:
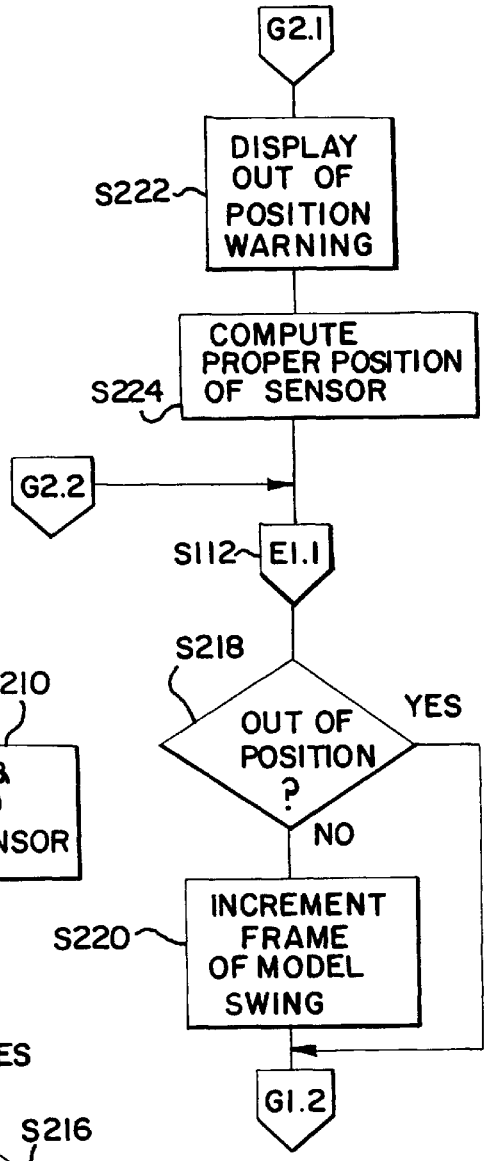

If the golfer believes that his or her swing is an improvement or wishes to chronicle his or her swing through the golf season, the swing can be saved according to the program shown by FIG. 17. The program is started by moving the clubhead to the area (J) labeled "SAVE" on control pad 4. Computer 36 then opens a file for the player (S192) and stores the three dimensional positions for the sensors in each of the frames of the stored swing together with other relevant information such as ball position (S194). The file is then closed (S196) until retrieved at a later time in the compare swing program of FIG. 15, for example.

The golfer may believe that there is such a difference in his or her present swing with an ideal swing that one or more lessons need to be taken. The golfer may elect to perform several interactive training routines with the present golf swing analysis system. These training routines are begun by moving the clubhead face 25 to the area (M) labeled "TRAINER" on control pad 4 wherein the program is actuated (S198). A display of instructions is shown on monitor 38 which describe exercises available to the golfer, including addressing the ball, swinging the club to the top, the complete swing, etc. The golfer selects one of the displayed swing movements by entering the corresponding menu item from the keyboard 40 or control pad 4 (S202). Computer 36 then reads the viewing options from the viewing option file (S204).

Computer 36 then sequentially reads and stores the position of each sensor 6, 20 for a single frame of the golfer's current swing (S206, S208, S210). Then computer 36 performs the analysis program of FIG. 16 for the current swing and the corresponding frame of the previously selected model swing (S212).

If all sensors are in alignment, the playback routine is invoked and the current swing position and the corresponding frame of the model swing are displayed (S112). The frame index for the model swing is incremented (S218, S220). The computer emits a tone indicating that the golfer has achieved the model position and that he or she should move to the next position. At this point the computer 36 repeats the process of reading sensor locations (S206).

If the analysis indicates that a sensor 6, 20 is out of position, a message is displayed on monitor 38 describing the misalignment (S214, S222). The current swing and model swing are then displayed with a yellow line showing the correct position of the sensor 6, 20 (S112, S224). With this information the golfer incrementally moves his position to try to match the model position. Computer 36 then repeats the process by reading the sensor positions again (S206).

The above process is repeated for each frame of the chosen training exercise. The result is that the golfer develops muscle memory of the model swing by repetitively changing his swing until the swing is aligned.

When the player has completed the training session, the golfer may select any of the requests depicted in FIG. 6. The player at any time may quit the session with the golf swing analysis system by moving the clubhead to the QUIT area (L) of control pad 4 where maintenance, such as updating the number of swings saved, etc., of the golfer's file is performed (S228).

The foregoing description is provided to illustrate the invention, and is not to be construed as a limitation. Numerous additions, substitutions and other changes can be made to the invention without departing from its scope as set forth in the appended claims.

Figure 19:
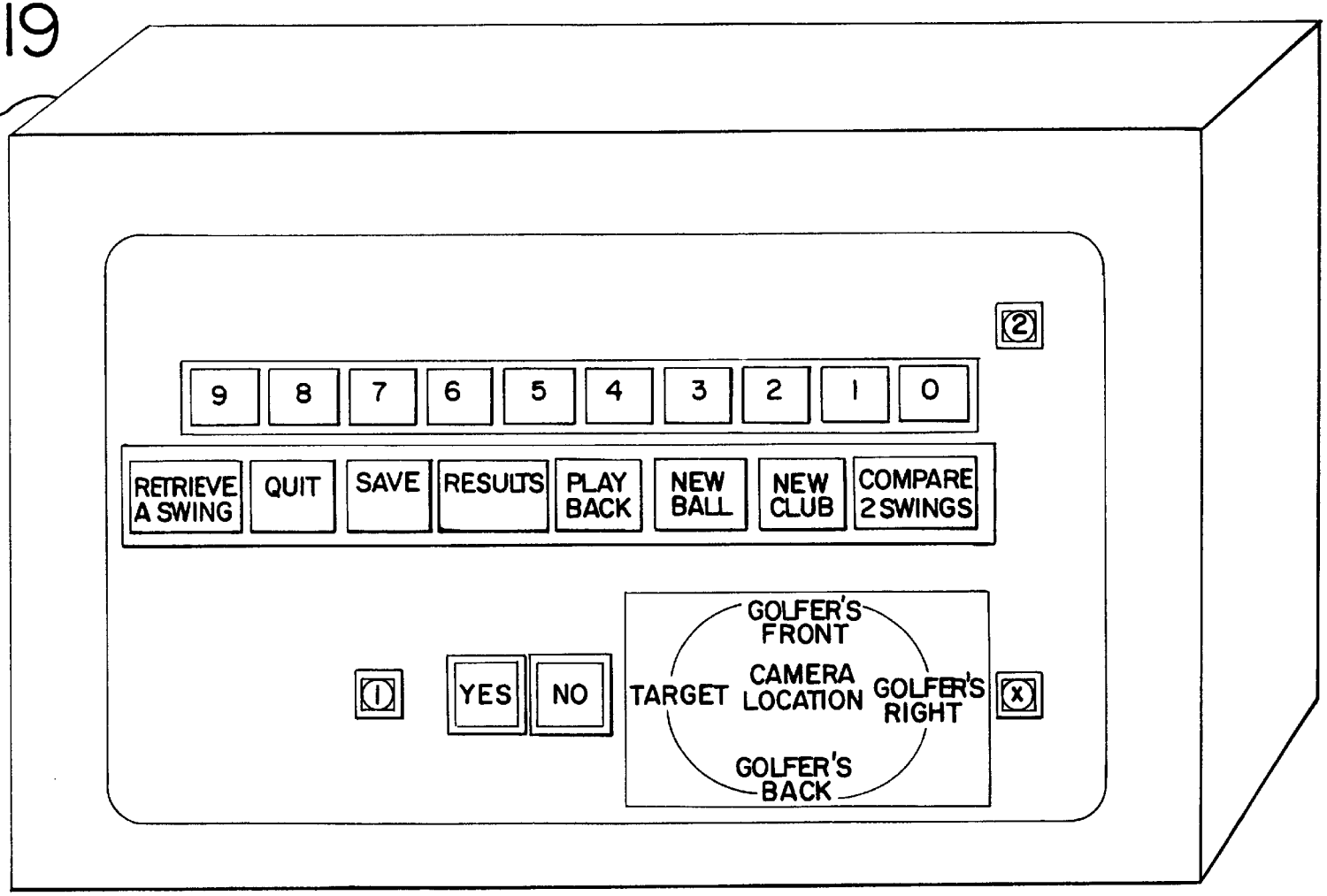
FIG. 19 shows a second embodiment of a control surface according to the present invention.

For example, alternate ways of selecting programs and responding to prompts are possible. In one embodiment, the club face 25 acts like a mouse in that it controls the movement of a cursor on the screen of monitor 38. Monitor 38 preferably displays labeled areas that correspond in relative shape and position with the labeled areas of control pad 4. As seen in FIG. 19, the areas may be labeled exactly as the areas of control pad 4 are or as icons. The pixel positions of these displayed areas are stored in computer 36. In a manner similar to that described previously for control pad 4, a program or operation is associated with each of the displayed areas.

The programs of FIGS. 6–18 are initiated by moving the clubhead along the calibrated pad 4, as described previously. Clubhead face 25 position is computed relative to the center of the control pad 4 and computer 36 then converts the signal to a cursor signal having the same relative row and column position on the screen of monitor 38. Thus, by moving the clubhead the cursor on the monitor 38 moves as well. Computer 36 then compares the position of the cursor with the stored positions of the displayed areas. If the positions match, then the program corresponding to the displayed area is performed. To aid in moving the cursor, control pad 4 may be employed so that by moving the clubhead to one of the areas on pad 4, such as the PLAYBACK area, then the cursor will move to the area labeled PLAYBACK on monitor 38 and perform the Playback program.

I claim:

1. A motion analysis system for analyzing the motion of an individual, said system comprising:

a radiation source that emits radiation;

a first sensor attached to a part of an arm of said individual, wherein the arm is in contact with an object and said first sensor receives a portion of said radiation emitted from said radiation source and producing a first signal representative of said position of said part of said arm;

an analyzer for receiving said first signal from said first sensor and computing the three dimensional position of said part of said arm of said individual, and said analyzer computing the three dimensional position of said object.

2. The motion analysis system of claim 1, wherein said object comprises a piece of sports equipment.

3. The motion analysis system of claim 2, wherein said piece of sports equipment comprises a golf club.

4. The motion analysis system of claim 2, wherein said piece of sports equipment comprises a baseball bat.

5. The motion analysis system of claim 2, wherein said piece of sports equipment comprises a hockey stick.

6. The motion analysis system of claim 2, wherein said piece of sports equipment comprises a tennis racket.

7. The motion analysis system of claim 1, wherein said radiation source emits magnetic fields.

8. The motion analysis system of claim 7, wherein said first sensor detects six degrees of freedom of said part from said emitted magnetic fields.

9. The motion analysis system of claim 1, further comprising:

a radio-frequency transmitter attached to said first sensor and sending said first signal to said analyzer;

said analyzer comprises a radio-frequency receiver to receive said first signal sent by said radio-frequency transmitter.

10. The motion analysis system of claim 1, wherein said first sensor is attached to a piece of clothing worn by said individual.

11. The motion analysis system of claim 1, comprising a view selector that rotates the calculated three dimensional positions of said part and said object by an amount determined by said individual;

said rotated positions of said part and said object are shown on said display.

12. The motion analysis system of claim 1, further comprising:

a memory storing model positions of said part and said object;

said analyzer calculating a vector from said model position of either said part or said object to the model position of the other of said part or said object and applying said vector to one of said calculated three dimensional positions of said part;

said analyzer applying said vector to the calculated position of either said part or said object to determine a preferred position of the other of said part or said object;

a comparator for comparing whether the preferred position is within a predetermined tolerance of the calculated three dimensional position of the other of said part or said object.

13. The motion analysis system of claim 12, wherein the direction cosines of said vector are used to determine the preferred position of the other of said part or said object.

14. The motion analysis system of claim 12, wherein said display shows a message that the swing is improper when the preferred position is not within the predetermined tolerance.

15. The motion analysis system of claim 1, further comprising a display for showing the position of the part and object based upon the computed three dimensional positions of said part and said object, respectively.

16. The motion analysis system of claim 1, further comprising a memory that stores an ideal motion of said individual.

17. The motion analysis system of claim 1, further comprising:

a memory that stores an ideal motion of said individual, and a display that displays said stored ideal motion.

18. A motion analysis system for analyzing the motion of an individual, said system comprising:

a radiation source that emits radiation;

a first sensor attached to a part of an arm of said individual, wherein the arm is in contact with an object and said first sensor receives a portion of said radiation emitted from said radiation source and producing a first signal representative of said position of said part of said arm;

a second sensor attached to a second part of said individual for receiving a second portion of said radiation emitted from said radiation source and producing a second signal representative of said position of said second part;

an analyzer for receiving said first signal from said first sensor and computing the three dimensional position of said first part of said individual, and said analyzer receives said second signal from said second sensor and computing the three dimensional position of said second part of said individual.

19. The motion analysis system of claim 18, wherein said radiation source emits magnetic fields.

20. The motion analysis system of claim 19, wherein said first sensor detects six degrees of freedom of said first part from said emitted magnetic fields.

21. The motion analysis system of claim 18, further comprising:

a radio-frequency transmitter attached to said first sensor and sending said first signal to said analyzer;

said analyzer comprises a radio-frequency receiver to receive said first signal sent by said radio-frequency transmitter.

22. The motion analysis system of claim 18, wherein said first sensor is attached to a piece of clothing worn by said individual.

23. The motion analysis system of claim 18, comprising a view selector that rotates the calculated three dimensional positions of said first and second parts by an amount determined by said individual;

said rotated positions of said first and second parts are shown on said display.

24. The motion analysis system of claim 18, further comprising:

a memory storing model positions of said first and second parts;

said analyzer calculating a vector from said model position of said first part to the model position of the second part;

said analyzer applying said vector to the calculated position of said first part to determine a preferred position of said second part;

a comparator for comparing whether the preferred position is within a predetermined tolerance of the calculated three dimensional position of said second part.

25. The motion analysis system of claim 24, wherein the direction cosines of said vector are used to determine the preferred position of said second part.

26. The motion analysis system of claim 24, wherein said display shows a message that the swing is improper when the preferred position is not within the predetermined tolerance.

27. The motion analysis system of claim 18, further comprising a display for showing the position of the first and second parts based upon the computed three dimensional positions of said first and second parts, respectively.

28. The motion analysis system of claim 18, further comprising a memory that stores an ideal motion of said individual.

29. The motion analysis system of claim 18, further comprising:

a memory that stores an ideal motion of said individual, and a display that displays said stored ideal motion.

* * * * *